US011510838B2

(12) United States Patent
La Porta

(10) Patent No.: US 11,510,838 B2
(45) Date of Patent: Nov. 29, 2022

(54) METHODS, APPARATUSES AND SYSTEMS FOR APPLYING PRESSURE TO A NEWBORN BABY

(71) Applicant: Dallas La Porta, West Vancouver (CA)

(72) Inventor: Dallas La Porta, West Vancouver (CA)

( * ) Notice: Subject to any disclaimer, the term of this patent is extended or adjusted under 35 U.S.C. 154(b) by 0 days.

(21) Appl. No.: 16/650,260

(22) PCT Filed: Mar. 5, 2019

(86) PCT No.: PCT/CA2019/050267
§ 371 (c)(1),
(2) Date: Mar. 24, 2020

(87) PCT Pub. No.: WO2019/169489
PCT Pub. Date: Sep. 12, 2019

(65) Prior Publication Data

US 2020/0390631 A1 Dec. 17, 2020

Related U.S. Application Data

(60) Provisional application No. 62/639,186, filed on Mar. 6, 2018.

(51) Int. Cl.
*A61H 1/00* (2006.01)

(52) U.S. Cl.
CPC ..... *A61H 1/006* (2013.01); *A61H 2201/0103* (2013.01); *A61H 2201/0157* (2013.01);
(Continued)

(58) Field of Classification Search
None
See application file for complete search history.

(56) References Cited

U.S. PATENT DOCUMENTS 3,636,566 A 1/1972 Sutherland
5,245,990 A 9/1993 Bertinin
(Continued)

FOREIGN PATENT DOCUMENTS

CN 104188780 * 12/2014 ..... A61G 12/00
CN 104188780 B 1/2017
(Continued)

OTHER PUBLICATIONS

Carroll, Robert, "Elsevier's Integrated Physiology", 2007, Uterine Contraction page on ScienceDirect (Year: 2007).*
(Continued)

*Primary Examiner* — Bradley H Philips
*Assistant Examiner* — Savannah L Gabriel
(74) *Attorney, Agent, or Firm* — Borden Ladner Gervais LLP; Michael Damiani

(57) ABSTRACT

The present disclosure relates to an apparatus for applying pressure to a newborn baby. The apparatus defines a cavity for holding the newborn baby therein, and a plurality of expandable conduits that each substantially surround the cavity, where each conduit is independently expandable: (1) on transfer of fluid from a fluid source into the conduit; (2) on application of an electric potential from an electric potential source to the conduit; or (3) a combination thereof, to apply pressure along at least a portion of the length of the newborn baby held in the cavity. The present disclosure also discusses methods of applying pressure to a newborn baby in a pressure applying apparatus, and systems for applying pressure to a newborn baby.

18 Claims, 31 Drawing Sheets

(52) U.S. Cl.
CPC ..... *A61H 2201/1238* (2013.01); *A61H 2201/169* (2013.01); *A61H 2201/5023* (2013.01); *A61H 2201/5056* (2013.01); *A61H 2201/5071* (2013.01); *A61H 2203/0443* (2013.01)

(56) References Cited

U.S. PATENT DOCUMENTS

| | | | | |
|---|---|---|---|---|
| 7,614,099 | B2 | 11/2009 | Goetz | |
| 8,192,381 | B2 | 6/2012 | Mozzarella | |
| 8,607,364 | B2 | 12/2013 | Barski | |
| 9,320,674 | B2 | 4/2016 | Fraser | |
| 2002/0100116 | A1* | 8/2002 | Richards | A47D 9/02 5/108 |
| 2005/0183722 | A1 | 8/2005 | Bilgi | |
| 2008/0195018 | A1* | 8/2008 | Larson | A61H 7/00 602/53 |
| 2008/0201858 | A1* | 8/2008 | Caminade | F16K 31/0651 5/713 |
| 2010/0137750 | A1 | 6/2010 | Grall | |
| 2011/0087143 | A1 | 4/2011 | Bobey et al. | |
| 2013/0036536 | A1 | 2/2013 | Breindahl et al. | |
| 2013/0104279 | A1 | 5/2013 | Galli, Jr. et al. | |
| 2013/0247277 | A1 | 9/2013 | Turbovich | |
| 2014/0148739 | A1* | 5/2014 | Nour | A61H 31/006 601/41 |
| 2015/0120201 | A1* | 4/2015 | Silver | A61H 31/005 702/19 |
| 2016/0000640 | A1 | 1/2016 | Lai et al. | |
| 2016/0008206 | A1* | 1/2016 | Devanaboyina | A61M 21/02 601/136 |
| 2018/0055685 | A1* | 3/2018 | Campos | A61B 18/02 |
| 2018/0214341 | A1* | 8/2018 | Jeyaprakash | A61N 1/0456 |
| 2020/0016025 | A1* | 1/2020 | Devanaboyina | A61H 1/006 |

FOREIGN PATENT DOCUMENTS

| | | | |
|---|---|---|---|
| GB | 2418862 | A | 4/2006 |
| WO | 2005084582 | A1 | 9/2005 |
| WO | 2012046068 | A1 | 4/2012 |
| WO | 2015157154 | A1 | 10/2015 |
| WO | 2017079780 | A1 | 5/2017 |

OTHER PUBLICATIONS

International Patent Application No. PCT/CA2019/050267, International Search Report and Written Opinion dated May 24, 2019.
European Patent Application No. 19763193.0, Extended European Search Report dated Oct. 26, 2021.
European Patent Application No. 19763193.0, Office Action dated Nov. 12, 2021.

* cited by examiner

METHODS, APPARATUSES AND SYSTEMS FOR APPLYING PRESSURE TO A NEWBORN BABY

FIELD

The present disclosure relates to a method, apparatus, and system for applying pressure to a newborn baby.

BACKGROUND

The following paragraphs are not an admission that anything discussed in them is prior art or part of the knowledge of persons skilled in the art.

A fetus develops with its lungs filled with fetal lung liquid. During fetal life, the fetal lung liquid plays an important role in the growth and development of the lungs. During birth, a newborn baby must rapidly clear its lungs' air spaces of fetal lung liquid to transition to air breathing. Failure to do so may cause the baby to develop respiratory distress syndrome.

INTRODUCTION

The following introduction is intended to introduce the reader to this specification but not to define any invention. One or more inventions may reside in a combination or sub-combination of the instrument elements or method steps described below or in other parts of this document. The inventors do not waive or disclaim their rights to any invention or inventions disclosed in this specification merely by not describing such other invention or inventions in the claims.

During birth, a newborn baby's lungs must be clear of fetal lung liquid to transition from intrauterine liquid breathing to postnatal air breathing. In some instances of vaginal birth, the vaginal canal does not squeeze out a sufficient amount of fetal lung liquid from the newborn baby's lungs, for example, during instances of rapid vaginal deliveries and when the newborn baby is large. Furthermore, caesarean births do not provide the same mechanical squeeze as vaginal births.

Following birth, when a newborn baby shows signs of failing to clear a sufficient amount of fetal lung liquid from its lungs, physicians may treat the newborn baby by: (1) supplying oxygen to the newborn baby; (2) tube feeding the newborn baby if its breathing is too high; (3) providing continuous positive airway pressure using a mechanical breathing machine to help prevent the baby from breathing in food into its lungs; or (4) a combination thereof.

Supplying oxygen to a newborn baby under an oxygen hood, providing intravenous fluid supplementations, and providing continuous airway pressure may require admission into a neonatal intensive care unit and therefore results in the newborn baby being separated from its family, and interrupts early bonding and feeding. Moreover, admission into the neonatal intensive care unit may prolong the hospital stay.

There remains a need for a pressure applying apparatus that can be used on a newborn baby immediately after its birth that mimics a vaginal squeeze to promote the movement of fetal lung liquid out of the newborn baby's lungs.

The present disclosure provides an apparatus for applying pressure to a newborn baby. Generally, the apparatus generates a wave of pressure along the torso of the newborn baby to squeeze fetal lung liquid out of the newborn baby's lungs. Optionally, the apparatus is portable and/or may be used to apply the wave of pressure to a newborn baby in the delivery room soon after birth.

The present disclosure also discusses methods of applying pressure to a newborn baby, as well as systems that incorporate the apparatus described above.

Herein described exemplary apparatuses, methods, and systems may: (1) increase the efficiency of removing fetal lung liquid out of one or more of the lungs of a newborn baby; (2) decrease the time of separation between the newborn baby and its family; (3) decrease prolonged hospital stays; or (4) a combination thereof, by, for example: (1) mimicking the vaginal squeeze of a vaginal birth; (2) being applied to the newborn baby soon after its birth; (3) being applied to the newborn baby in the delivery room; or (4) a combination thereof.

The present disclosure discusses an apparatus for applying pressure to a newborn baby. The apparatus defines a cavity for holding the newborn baby therein. The apparatus comprises a plurality of expandable conduits that each substantially surround the cavity, wherein each conduit is independently expandable: (1) on transfer of fluid from a fluid source into the conduit; (2) on application of an electric potential from an electric potential source to the conduit; or (3) a combination thereof, to apply pressure along at least a portion of the length of the newborn baby held in the cavity.

Each conduit may be independently expandable on transfer of fluid from a fluid source into the conduit. The fluid may be liquid or gas. The side of each conduit proximal the cavity may be expandable and the opposite side of each conduit may be non-expandable. Each conduit may be made of an elastomer. The elastomer on the side of each expandable conduit proximal to the cavity may have a lower resilience than the elastomer on the opposite side of each expandable conduit.

Each conduit may be independently expandable on application of an electric potential from an electric potential source to the conduit. The conduit may be made of a nanostructure comprising metal and an electrolyte.

The apparatus may further comprise an exterior shell coupled to the opposite side of each expandable conduit. The exterior shell may be made of a metal material, a composite material, or a plastic material.

The apparatus may further comprise an interior shell coupled to the side of each expandable conduit proximal to the cavity. The interior shell may be made of a medical grade polymer.

The apparatus may have an open end for inserting the baby into the cavity, and may comprise an expandable bladder opposite the open end that is connected to: (1) a fluid source and expandable on transfer of fluid from the fluid source into the bladder; (2) an electric potential source and expandable on application of electric potential to the bladder; or (3) a combination thereof, to apply pressure to the distal end of the newborn baby held in the cavity.

The expandable bladder opposite the open end may be connected to a fluid source and expandable on transfer of fluid from the fluid source into the bladder.

The present disclosure also discusses a method for applying pressure to a newborn baby in a pressure applying apparatus, where the pressure applying apparatus comprises a plurality of independently operable pressure applying portions. The method may comprise independently applying pressure using each of the pressure applying portions to generate a wave of pressure along at least a portion of the length of the newborn baby.

Each of the plurality of pressure applying portions may apply a pressure around the newborn baby in a plane about perpendicular to the length of the newborn baby.

The pressure applying apparatus may further comprise a distal pressure applying portion, and further comprises applying pressure using the distal pressure portion to generate a pressure at the distal end of the newborn baby to push the newborn baby through the apparatus.

The method may further comprise a step of determining the volume of the newborn baby.

The method may comprise the pressure applying apparatus discussed in the present disclosure.

The present disclosure also discusses a system for applying pressure to a newborn baby, the system comprising: the herein described apparatus, a pressure sensor, and any one of: (1) a value controller coupled to the apparatus, a pump coupled to the value controller, and a processor in communication with: the apparatus; the valve controller; the pump; and the pressure sensor, and configured to control the amount of fluid transferred to the expandable conduits; (2) an electric potential controller coupled to the apparatus, and a processor in communication with: the apparatus; the pressure sensor, and the electric potential controller, and configured to control the amount of electric potential applied to the expandable conduits; and (3) a combination thereof.

The system may comprise: (1) a value controller coupled to the apparatus, a pump coupled to the value controller, and a processor in communication with: the apparatus; the valve controller; the pump; and the pressure sensor, and configured to control the amount of fluid transferred to the expandable conduits.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

FIGS. 3A-D are illustrations of another example of an apparatus according to the present disclosure in perspective views (FIGS. 3A and B), a perspective cross-sectional view (FIG. 3C), and a top planar view (FIG. 3D). The dashed arrow illustrates the axis of length of a newborn baby.

DETAILED DESCRIPTION

Figure 1A:
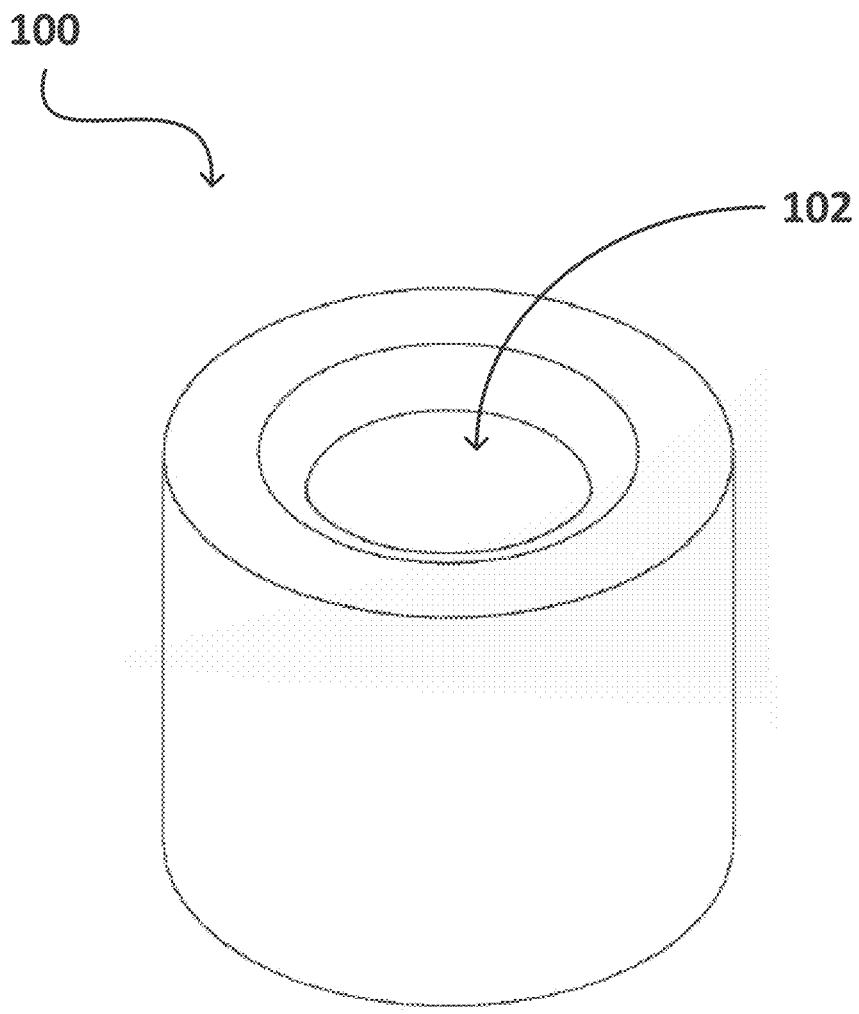
FIGS. 1A-D are illustrations of an example of an apparatus according to the present disclosure in perspective views (FIGS. 1A and B), a perspective cross-sectional view (FIG. 1C), and a top planar view (FIG. 1D). The dashed arrow illustrates the axis of length of a newborn baby.
Figure 1B:
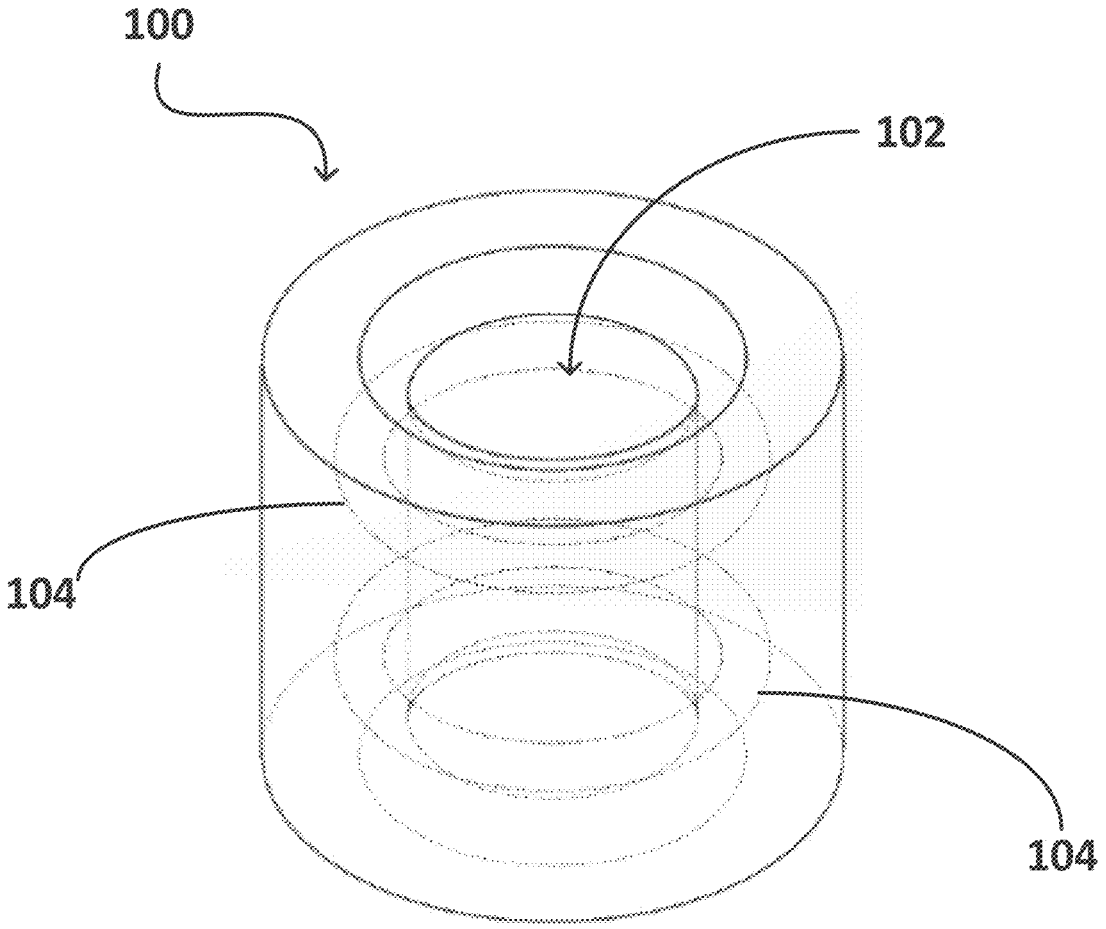
Figure 1C:
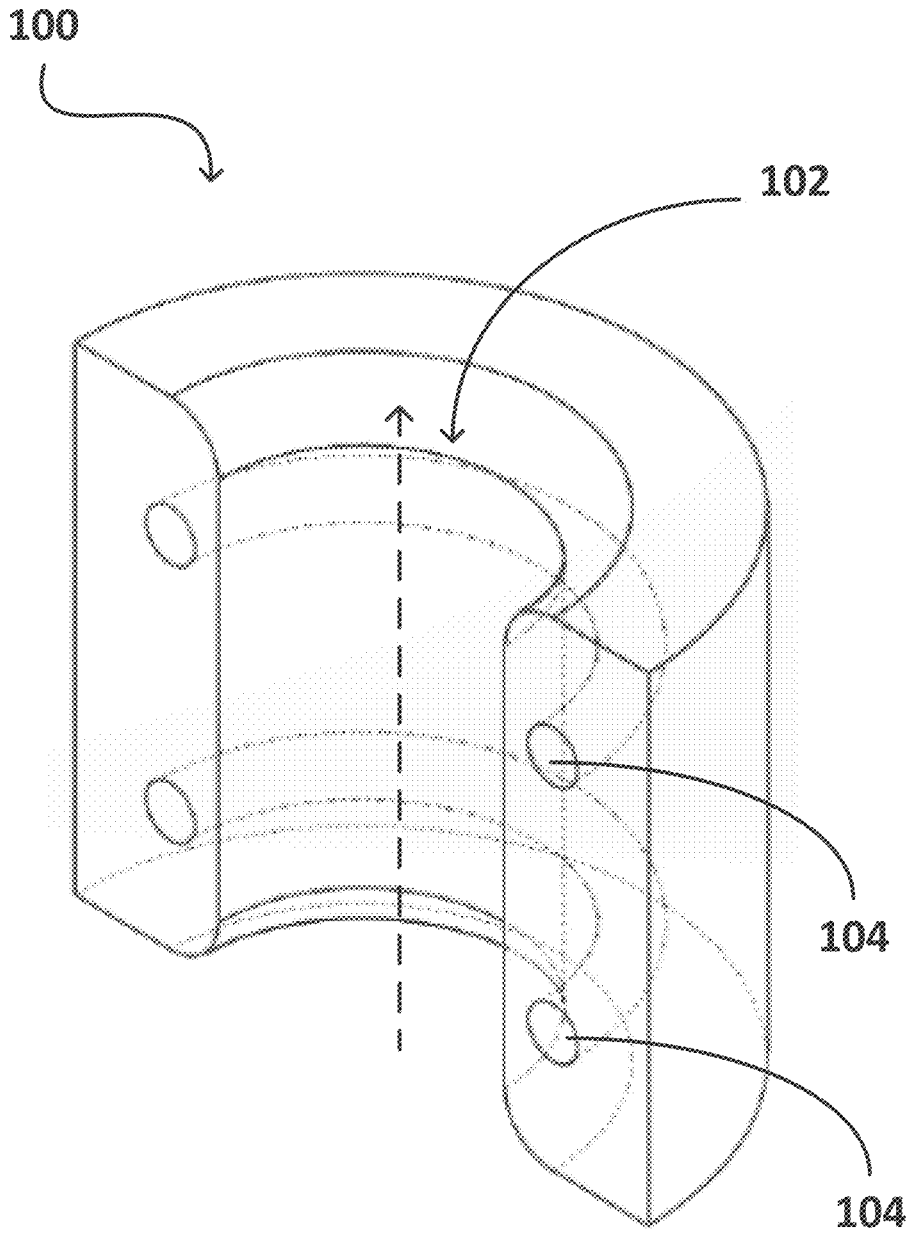
Figure 1D:
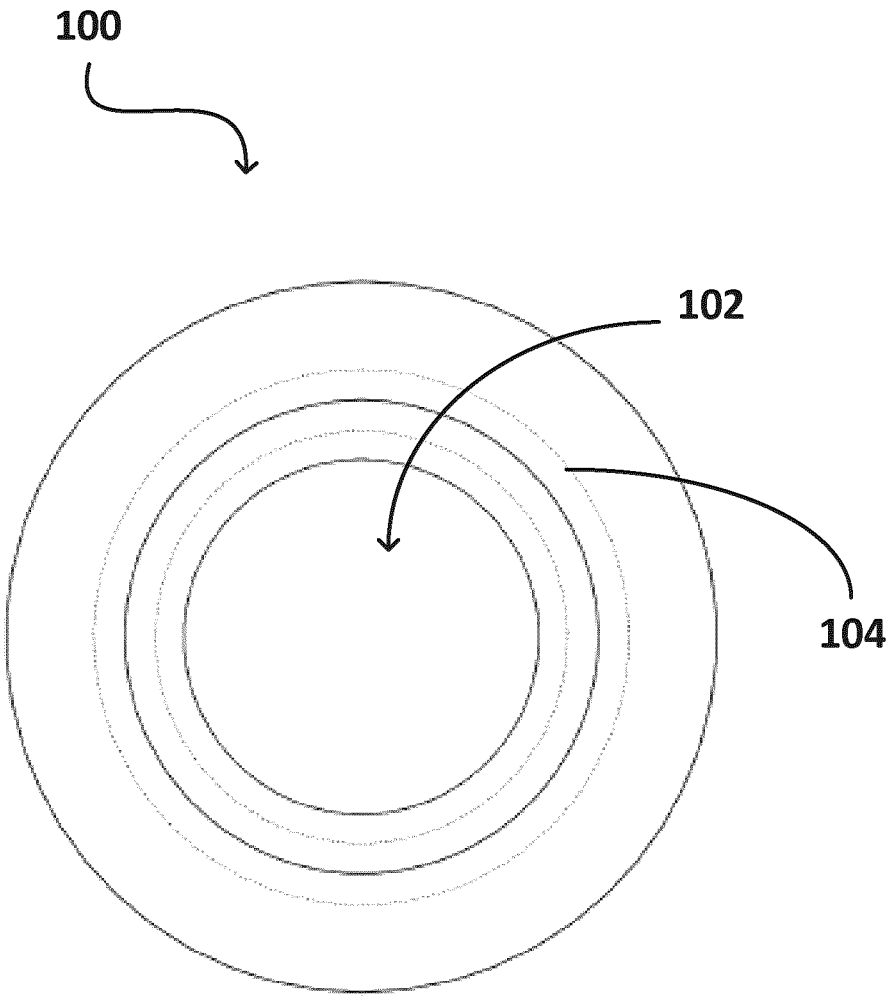

Generally, the present disclosure provides an apparatus for applying pressure to a newborn baby. The apparatus defines a cavity for holding the newborn baby therein, and comprises a plurality of expandable conduits that each substantially surround the cavity. Each conduit is independently expandable: (1) on transfer of fluid from a fluid source into the conduit; (2) on application of an electric potential from an electric potential source to the conduit; or (3) a combination thereof, to apply pressure along at least a portion of the length of the newborn baby held in the cavity.

The present disclosure also provides a method for applying pressure to a newborn baby in a pressure applying apparatus. The pressure applying apparatus comprises a plurality of independently operable pressure applying portions. The method comprises independently applying pressure using each of the pressure applying portions to generate a wave of pressure along at least a portion of the length of the newborn baby.

The present disclosure further provides a system for applying pressure to a newborn baby. The system comprises: the apparatus according to the present disclosure; a pressure sensor, coupled to the apparatus; and any one of the group selected from: (1) a value controller coupled to the apparatus, a pump coupled to the value controller, and a processor in communication with: the apparatus; the valve controller; the pump; and the pressure sensor, and configured to control the amount of fluid transferred to the expandable conduits; (2) an electric potential controller coupled to the apparatus, and a processor in communication with: the apparatus; the pressure sensor, and the electric potential controller, and configured to control the amount of electric potential applied to the expandable conduits; and (3) a combination thereof.

In the context of the preset disclosure, a newborn baby refers to a baby from the time of the baby's birth until the baby is about 1 month old. A skilled person would understand that the practice for determining the time of birth may vary from birth to birth and hospital to hospital. In some examples according to the present disclosure, the time of birth is the time at which the baby's entire head and body are out of the mother. In the context of the present disclosure, birth refers to both vaginal birth and caesarean section delivery.

Applying pressure to the newborn baby refers to at least two independent pressures being applied that generate a wave of pressure along at least a portion of the length of the newborn baby's body sufficient to: (1) squeeze fetal lung liquid out of one or more of the newborn baby's lungs; (2) move the newborn baby along its axis of length; or (3) a combination thereof. In the context of the present disclosure, the length of the newborn baby refers to an axis that runs from the top of the head to the heel of one foot of the newborn baby.

Generating a wave of pressure along the length of the newborn baby's body refers to applying a first pressure at a first location along the length of the newborn baby's body followed by applying a second pressure at a second location along the length of the newborn baby's body. In some examples according to the present disclosure, the second location is on the side of the first location that is closer to the newborn baby's head. In other examples according to the present disclosure, the second location is on the side of the first location that is closed to the newborn baby's feet. One sequence of applying a first pressure followed by applying a second pressure is considered one wave of pressure. In some examples according to the present disclosure, more than two pressures are applied to generate a wave of pressure along a portion of the length of the newborn baby's body. In some examples according to the present disclosure, following applying a first pressure, each pressure is applied at a location along the length of the newborn baby's body that is on the side of the location of the previously applied pressure that is closer to the newborn baby's head. In other examples according to the present disclosure, following applying a first pressure, each pressure is applied at a location along the length of the newborn baby's body that is on the side of the location of the previously applied pressure that is closer to the newborn baby's feet. In the context of more than two applying pressures, one sequence in which each applied pressure is applied once on the newborn baby's body is considered one wave of pressure.

The number of applied pressures in each generated wave of pressure along the length of the newborn baby's body may vary provided that the wave is sufficient to: (1) squeeze fetal lung liquid out of one or more of the newborn baby's lungs; (2) move the newborn baby along its axis of length; or (3) a combination thereof. In some examples according to the present disclosure, the number of applied pressures in each generated wave of pressure along the length of the newborn baby's body is from 2 to 100, for example, 2 applied pressures; 3 applied pressures; 4 applied pressures; 5 applied pressures; 6 applied pressures; 7 applied pressures; 8 applied pressures; 9 applied pressures; 10 applied pressures; 11 applied pressures; 12 applied pressures; 13 applied pressures; 14 applied pressures; 15 applied pressures; 16 applied pressures; 17 applied pressures; 18 applied pressures; 19 applied pressures; 20 applied pressures; 21 applied pressures; 22 applied pressures; 23 applied pressures; 24 applied pressures; 25 applied pressures; 26 applied pressures; 27 applied pressures; 28 applied pressures; 29 applied pressures; 30 applied pressures; 31 applied pressures; 32 applied pressures; 33 applied pressures; 34 applied pressures; 35 applied pressures; 36 applied pressures; 37 applied pressures; 38 applied pressures; 39 applied pressures; 40 applied pressures; 41 applied pressures; 42 applied pressures; 43 applied pressures; 44 applied pressures; 45 applied pressures; 46 applied pressures; 47 applied pressures; 48 applied pressures; 49 applied pressures; 50 applied pressures; 50 applied pressures; 51 applied pressures; 52 applied pressures; 53 applied pressures; 54 applied pressures; 55 applied pressures; 56 applied pressures; 57 applied pressures; 58 applied pressures; 59 applied pressures; 60 applied pressures; 61 applied pressures; 62 applied pressures; 63 applied pressures; 64 applied pressures; 65 applied pressures; 66 applied pressures; 67 applied pressures; 68 applied pressures; 69 applied pressures; 70 applied pressures; 71 applied pressures; 72 applied pressures; 73 applied pressures; 74 applied pressures; 75 applied pressures; 76 applied pressures; 77 applied pressures; 78 applied pressures; 79 applied pressures; 80 applied pressures; 81 applied pressures; 82 applied pressures; 83 applied pressures; 84 applied pressures; 85 applied pressures; 86 applied pressures; 87 applied pressures; 88 applied pressures; 89 applied pressures; 90 applied pressures; 91 applied pressures; 92 applied pressures; 93 applied pressures; 94 applied pressures; 95 applied pressures; 96 applied pressures; 97 applied pressures; 98 applied pressures; 99 applied pressures; 100 applied pressures or the number of pressures is between any one of the numbers listed above and any one of the other numbers listed above.

The amount of time between each of the applied pressures in each generated wave of pressure may vary provided that the wave is sufficient to: (1) squeeze fetal lung liquid out of one or more of the newborn baby's lungs; (2) move the newborn baby along its axis of length; or (3) a combination thereof. The amount of time may be determined from the time an applied pressure is at its complete applied state until the time an immediately subsequent applied pressure is at its complete applied state. In some examples according to the present disclosure, the amount of time between each immediately subsequent applied pressure on the newborn baby's body in one generated wave of pressure may be, independently, about 0.1 seconds; 0.2 seconds; 0.3 seconds; 0.4 seconds; 0.5 seconds; 0.6 seconds; 0.7 seconds; 0.8 seconds; 0.9 seconds; 1.0 seconds; 1.5 seconds; 2.0 seconds; 2.5 seconds; 3.0 seconds; 3.5 seconds; 4.0 seconds; 4.5 seconds; 5.0 seconds; 5.5 seconds; 6.0 seconds; 6.5 seconds; 7.0 seconds; 7.5 seconds; 8.0 seconds; 8.5 seconds; 9.0 seconds; 9.5 seconds; 10.0 seconds; or the time is between any one of the times listed above and any one of the other times listed above. In some examples according to the present disclosure, the amount of time between each immediately subsequent applied pressure on the newborn baby's body in one generated wave of pressure is decreased, for example when: (1) decreasing the time the newborn baby remains in the presently disclosed apparatus; (2) increasing the rate at which fetal lung liquid is removed from one or more of the newborn baby's lungs; or (3) a combination thereof, is desirable. In some examples according to the present disclosure, the amount of time between each immediately subsequent applied pressure on the newborn baby's body in one generated wave of pressure is increased, for example when: (1) increasing the time the newborn baby remains in the presently disclosed apparatus; (2) decreasing the rate at which fetal lung liquid is removed from one or more of the newborn baby's lungs; or (3) a combination thereof, is desirable. In some examples according to the present disclosure, the amount of time between each of the applied pressures in each generated wave of pressure may be adjusted to mimic vaginal labour contractions, for example, the amount of time from the generation of one wave to the destruction of the same wave may be about 1 minute.

The number of generated waves of pressure applied on the newborn baby's body may vary provided that the number of waves is sufficient to: (1) squeeze fetal lung liquid out of one or more of the newborn baby's lungs; (2) move the newborn baby along its axis of length; or (3) a combination thereof. In some examples according to the present disclosure, the number of waves is higher, for example when: (1) the newborn baby is larger; (2) the newborn baby has an increased amount of fetal lung liquid in one or more of its lungs; or (3) a combination thereof. In some examples according to the present disclosure, the number of waves is from 1 wave to 100 waves, for example, 1 wave; 2 waves; 3 waves; 4 waves; 5 waves; 6 waves; 7 waves; 8 waves; 9 waves; 10 waves; 11 waves; 12 waves; 13 waves; 14 waves; 15 waves; 16 waves; 17 waves; 18 waves; 19 waves; 20 waves; 21 waves; 22 waves; 23 waves; 24 waves; 25 waves; 26 waves; 27 waves; 28 waves; 29 waves; 30 waves; 31 waves; 32 waves; 33 waves; 34 waves; 35 waves; 36 waves; 37 waves; 38 waves; 39 waves; 40 waves; 41 waves; 42 waves; 43 waves; 44 waves; 45 waves; 46 waves; 47 waves; 48 waves; 49 waves; 50 waves; 50 waves; 51 waves; 52 waves; 53 waves; 54 waves; 55 waves; 56 waves; 57 waves; 58 waves; 59 waves; 60 waves; 61 waves; 62 waves; 63 waves; 64 waves; 65 waves; 66 waves; 67 waves; 68 waves; 69 waves; 70 waves; 71 waves; 72 waves; 73 waves; 74 waves; 75 waves; 76 waves; 77 waves; 78 waves; 79 waves; 80 waves; 81 waves; 82 waves; 83 waves; 84 waves; 85 waves; 86 waves; 87 waves; 88 waves; 89 waves; 90 waves; 91 waves; 92 waves; 93 waves; 94 waves; 95 waves; 96 waves; 97 waves; 98 waves; 99 waves; 100 waves; or the number of waves is between any one of the waves listed above and any one of the other waves listed above.

The amount of time between each generated wave of pressure may vary provided that the waves are sufficient to: (1) squeeze fetal lung liquid out of one or more of the newborn baby's lungs; (2) move the newborn baby along its axis of length; or (3) a combination thereof. In some examples according to the present disclosure, the amount of time between each immediately subsequent generated wave of pressure may be, independently, from about 0.1 second to about 3 minutes, for example, 0.1 seconds; 0.2 seconds; 0.3 seconds; 0.4 seconds; 0.5 seconds; 0.6 seconds; 0.7 seconds; 0.8 seconds; 0.9 seconds; 1.0 seconds; 1.5 seconds; 2.0 seconds; 2.5 seconds; 3.0 seconds; 3.5 seconds; 4.0 seconds; 4.5 seconds; 5.0 seconds; 5.5 seconds; 6.0 seconds; 6.5 seconds; 7.0 seconds; 7.5 seconds; 8.0 seconds; 8.5 seconds; 9.0 seconds; 9.5 seconds; 10.0 seconds; 15.0 seconds; 20 seconds; 25 seconds; 30 seconds; 60 seconds; 90 seconds; 120 seconds; 180 seconds; 240 seconds; or the time is between any one of the times listed above and any one of the other times listed above. In some examples according to the present disclosure, the amount of time between each generated wave of pressure may be adjusted to mimic vaginal labour contractions, for example, the amount of time from each generated wave of pressure may be equivalent to the rest time between subsequent vaginal labour contractions.

In some examples according to the present disclosure, each of the plurality of pressure applying portions is independently operable and each may apply a different amount of pressure, for example when: (1) adjusting a wave of pressure applied on the newborn baby's body; (2) concurrently generating a plurality of waves of pressure applied on a newborn baby's body; (3) applying pressures to portions of the newborn baby's body independent of a generated wave of pressure; or (4) a combination thereof, is desirable. In some examples according to the present disclosure, at least one pressure applying portion applies a pressure at a portion of the newborn baby's body independent and concurrent with a wave of pressure being generated by a plurality of pressure applying portions and at a location along the baby's length that is on the side of generated wave that is closer to the newborn baby's head. This pressure applied by the pressure applying portion independent of the generated wave of pressure may squeeze fetal fluid liquid out of one or more of the newborn baby's lungs as the newborn baby is moved along its axis of length. In some examples according to the present disclosure, the amount of pressure applied by the pressure applying portion independent of the generated wave of pressure is from about 2.6 kPa to about 19 kPa, for example: 2.6 kPa; 3.0 kPa; 3.5 kPa; 4.0 kPa; 4.5 kPa; 5.0 kPa; 5.5 kPa; 6.0 kPa; 6.5 kPa; 7.0 kPa; 7.5 kPa; 8.0 kPa; 8.5 kPa; 9.0 kPa; 9.5 kPa; 10.0 kPa; 10.5 kPa; 11.0 kPa; 11.5 kPa; 12.0 kPa; 13.5 kPa; 14.0 kPa; 14.5 kPa; 15.0 kPa; 15.5 kPa; 16.0 kPa; 16.5 kPa; 17.0 kPa; 17.5 kPa; 18.0 kPa; 18.5 kPa; 19.0 kPa; or the pressure is between any one of the pressures listed above and any one of the other pressures listed above. In some examples according to the present disclosure, the amount of pressure applied by the pressure applying portion independent of the generated wave of pressure mimics a vaginal squeeze.

The amount of applied pressure by each pressure applying portion may vary provided that a generated wave of pressure is sufficient to: (1) squeeze fetal lung liquid out of one or more of the newborn baby's lungs; (2) move the newborn baby along its axis of length; or (3) a combination thereof. In some examples according to the present disclosure, the amount of pressure applied by each pressure applying portion may be, independently, from about 1 kPa to about 150 kPa, for example: 1 kPa; 2 kPa; 3 kPa; 4 kPa; 5 kPa; 6 kPa; 7 kPa; 8 kPa; 9 kPa; 10 kPa; 11 kPa; 12 kPa; 13 kPa; 14 kPa; 15 kPa; 16 kPa; 17 kPa; 18 kPa; 19 kPa; 20 kPa; 21 kPa; 22 kPa; 23 kPa; 24 kPa; 25 kPa; 26 kPa; 27 kPa; 28 kPa; 29 kPa; 30 kPa; 31 kPa; 32 kPa; 33 kPa; 34 kPa; 35 kPa; 36 kPa; 37 kPa; 38 kPa; 39 kPa; 40 kPa; 41 kPa; 42 kPa; 43 kPa; 44 kPa; 45 kPa; 46 kPa; 47 kPa; 48 kPa; 49 kPa; 50 kPa; 51 kPa; 52 kPa; 53 kPa; 54 kPa; 55 kPa; 56 kPa; 57 kPa; 58 kPa; 59 kPa; 60 kPa; 70 kPa; 80 kPa; 90 kPa; 100 kPa; 110 kPa; 120 kPa; 130 kPa; 140 kPa; 150 kPa; or the pressure is between any one of the pressures listed above and any one of the other pressures listed above. In some examples according to the present disclosure, the amount of applied pressure by each pressure applying portions generating a wave of pressure is from about 2.6 kPa to about 19 kPa.

A generated wave of pressure may provide an expulsive force on the newborn baby that ranges from about 10 N to about 350 N, for example, 20 N; 30 N; 40 N; 50 N; 60 N; 70 N; 80 N; 90 N; 100 N; 125 N; 150 N; 175 N; 200 N; 225 N; 250 N; 275 N; 300 N; 325 N; 350 N; or the force is between any one of the forces listed above and any one of the other forces listed above. In the context of the present disclosure, an expulsive force refers to a force applied to a newborn baby's body to move the newborn baby along its axis of length. In some examples according to the present disclosure, a generated wave of pressure provides an expulsive force on a newborn baby by squeezing a portion of the newborn baby's body causing the newborn baby to move in a direction away from the applied expulsive force.

In some examples according to the present disclosure, a distal pressure applying portion generates a pressure at the distal end of a newborn baby's body to move the newborn baby along its axis of length. In some examples according to the present disclosure, the distal pressure applying portion applies a pressure on the newborn baby's body independent from the plurality of pressure applying portions. In some examples according to the present disclosure, the distal pressure applying portion applies a pressure at the distal end of the newborn baby's body directly preceding a wave of pressure applied by the plurality of pressure applying portions, for example when: (1) increasing the efficiency of squeezing fetal fluid liquid out of one or more of the newborn baby's lungs; (2) increasing the efficiency of movement of the newborn baby along its axis of length; or (3) a combination thereof, is desirable.

The time between the distal pressure applying portion applying a pressure at the distal end of the newborn baby's body and the time the plurality of pressure applying portions initiate a wave of pressure may be about 0.1 seconds; 0.2 seconds; 0.3 seconds; 0.4 seconds; 0.5 seconds; 0.6 seconds; 0.7 seconds; 0.8 seconds; 0.9 seconds; 1.0 seconds; 1.5 seconds; 2.0 seconds; 2.5 seconds; 3.0 seconds; 3.5 seconds; 4.0 seconds; 4.5 seconds; 5.0 seconds; 5.5 seconds; 6.0 seconds; 6.5 seconds; 7.0 seconds; 7.5 seconds; 8.0 seconds; 8.5 seconds; 9.0 seconds; 9.5 seconds; 10.0 seconds; or the time is between any one of the times listed above and any one of the other times listed above.

In some examples according to the present disclosure, the distal pressure applying portion applies a substantially constant pressure at the distal end of the newborn baby's body during one or more waves of pressure generated by the plurality of pressure applying portions.

The amount of applied pressure by the distal pressure applying portion may vary provided that the pressure is sufficient to move the newborn baby along its axis of length. The amount of pressure applied by the distal pressure applying portion may be equivalent to a force from 0 N to about 300 N, for example, 0 N; 5 N; 10 N; 15 N; 20 N; 30 N; 40 N; 50 N; 60 N; 70 N; 80 N; 90 N; 100 N; 125 N; 150 N; 175 N; 200 N; 225 N; 250 N; 275 N; 300 N; or the force is between any one of the forces listed above and any one of the other forces listed above. The amount of applied pressure may vary and/or be adjusted over the course of one or more waves of pressure applied by the plurality of pressure applying portions. For example, the distally applied pressure may be increased when increasing the speed the newborn baby moves along its axis of length is desirable, or the distally applied pressure may be decreased when decreasing the speed the newborn baby moves along its axis is desirable.

In some examples according to the present disclosure, the wave of pressure is generated by a plurality of conduits that substantially surround a portion of the newborn baby's body and expand independently to apply pressure along at least a portion of the newborn baby's body.

In the context of the present disclosure, a conduit refers to any channel or tube that substantially surrounds a newborn baby's body and is expandable: (1) on transfer of fluid into the conduit; (2) on application of an electric potential to the conduit; or (3) a combination thereof. Surrounding the newborn baby's body refers to surrounding a newborn baby's body in a plane that extends about perpendicular to the axis of length of the newborn baby's body. In some examples according to the present disclosure, the plane extends at an angle of about 40°; about 45°; about 50°; about 60°; about 70°; about 80°; about 90°; about 100°; about 110°; about 130°; about 140°; about 145°; or the angle is between any one of the degrees listed above to any one of the other degrees listed above, from the axis of length of the newborn baby's body. In some examples according to the present disclosure, the conduit lies in a plane that extends at an angle from about 80° to about 100° from the axis of length of the newborn baby's body, for example when (1) increasing the efficiency of squeezing fetal fluid liquid out of one or more of the newborn baby's lungs; (2) increasing the efficiency of movement of the newborn baby along its axis of length; or (3) a combination thereof, is desirable.

Substantially surrounding the newborn baby's body refers to a conduit extending from about 50% to 100% around the newborn baby's body along a plane that extends about perpendicular to the axis of the length of the new born baby's body. In some examples according to the present disclosure, the conduit extends 100% around the newborn baby's body, for example when: (1) increasing the efficiency of squeezing fetal fluid liquid out of one or more of the newborn baby's lungs; (2) increasing the efficiency of movement of the newborn baby along its axis of length; or (3) a combination thereof, is desirable. In some examples according to the present disclosure, the conduit extends at least about 50%, at least about 75%, at least about 90%, at least about 95%, or 100% around the newborn baby's body.

The distance between the conduit when in an unexpanded state and the newborn baby's body may vary provided that there is a sufficient amount of space between the newborn baby's body and the unexpanded conduit for expansion of the conduit to apply a pressure on the newborn baby's body. A skilled person would understand that the distance between the conduit and the newborn baby's body may vary along the entire length of the unexpanded conduit, for example, when the newborn baby is contacting, directly or indirectly, one portion of an unexpanded conduit while another portion of the unexpanded conduit is not contacting, directly or indirectly, the newborn baby. Similarly, a skilled person would understand that the distance between each of the plurality of conduits in unexpanded states and the newborn baby's body may vary, for example when one conduit is proximal to a wider portion of the newborn baby's body, and another conduit is proximal a narrower portion of the newborn baby's body.

In some examples according to the present disclosure, at least a portion of the plurality of expandable conduits may be oriented in overlapping layers, for example, when: (1) increasing the volume of expansion of the expandable conduits(s); (2) increasing the pressure on the newborn baby; or (3) a combination therefor, is desirable. In some examples according to the present disclosure, each conduit orientated in overlapping layers is independently expandable: (1) on transfer of fluid into the conduit; (2) on application of an electric potential to the conduit; or (3) a combination thereof.

Expandable on transfer of fluid into each conduit refers to providing a sufficient amount of fluid from a fluid source into each conduit to cause at least a portion of the conduit to expand outwardly from the center of the conduit in an unexpanded state. A fluid source refers to any container of fluid that can provide fluid to the each herein described conduit, for example, a tank in fluid communication with each conduit. The fluid is any flowable substance that can be transferred into a conduit and may cause the conduit to expand. In some examples according to the present disclosure, the fluid is liquid or gas. In some examples according to the present disclosure, the fluid is liquid, for example when: (1) increasing temperature control; (2) decreasing compression compared to air which may allow greater control of the pressure applied; or (3) a combination thereof, is desirable. The temperature of the liquid fluid transferred into each conduit may be adjusted, for example, by a liquid heater.

Expandable on application of an electric potential to each conduit refers to providing sufficient electric potential from an electric potential source to each conduit to cause at least a portion of the conduit to expand outwardly from the center of the conduit in an unexpanded state. In some examples according to the present disclosure, each conduit is made of a hybrid nanostructure comprising metal, for example a metal backbone, that is interpenetrated by an electrolyte. An electric potential source refers to any energy source that converts one type of energy into electric energy, for example, an electrochemical cell. Without being bound by theory, the inventors believe that the application of an electric potential to the conduit polarizes the internal interface of the hybrid nanostructure and allows the conduit to alter between a softer, more ductile state and a more rigid, high strength state. The alteration of the conduit from a softer, more ductile state to a more rigid, high strength state may cause the conduit to expand. In some examples according to the present disclosure, the applied electric potential to each conduit may be from about 0.0001 V to about 100 V, for example, about 0.0001 V; about 0.0005 V; about 0.0010 V; about 0.0050 V; about 0.0100 V; about 0.0500 V; about 0.1000 V; about 0.5000 V; about 1.0000 V; about 2.0000 V; about 3.0000 V; about 4.0000 V; about 5.0000 V; about 6.0000 V; about 7.0000 V; about 8.0000 V; about 9.0000 V; about 10.0000 V; about 15.0000 V; 20.0000 V; 25.0000 V; 50.0000 V; 75.0000 V; 100.0000 V; or the electric potential is between any one of the electric potentials listed above and any one of the other electric potentials listed above. Preferably, the electric potential is less than about 10.0000 V.

Expandable with a combination of: (1) the transfer of fluid from a fluid source into the conduit; and (2) the application of an electric potential to the conduit, refers to providing a sufficient amount of fluid from the fluid source into the conduit to cause at least a portion of the conduit to expand outwardly from the center of the conduit in an unexpanded state and providing a sufficient electric potential from an electric potential source to the conduit to cause at least another portion of the conduit to expand outwardly from the center of the conduit in an unexpanded state. In some examples according to the present disclosure, the at least another portion of the conduit, upon application of an electric potential source, expands and becomes more rigid thereby impeding further expansion at the at least another portion while the at least a portion of the conduit, upon transfer of fluid therein, may continue to expand.

A skilled person would understand that each conduit may cycle between different degrees of expansion, or be in different degrees of an expansion state, depending on: (1) the amount of fluid that has been transferred into the conduit; (2) the electric potential applied to the conduit; or (3) a combination thereof.

In the examples in which the transfer of fluid is used to expand each of the plurality of conduits, each of the plurality of conduits may be coupled, independently, to a separate pump that introduces fluid into each of the plurality of conduits. In some examples according to the present disclosure, each of the plurality of conduits is coupled, independently, to a separate pump via a network of tubes or system of tubes. In some examples according to the present disclosure, more than one of the plurality of conduits is coupled, independently, to the same pump and introduction of fluid into the more than one the plurality of conduits is adjusted by one or more valves in the network of tubes or system of tubes.

The: (1) expandability; (2) size; and (3) shape of each conduit may vary provided that the plurality of conduits are able to generate a wave of pressure sufficient to: (1) squeeze fetal lung liquid out of one or more of the newborn baby's lungs; (2) move the newborn baby along its axis of length; or (3) a combination thereof. In some examples according to the present disclosure, all sides of each of the plurality of conduits are expandable. In other examples according to the present disclosure, the side of each conduit proximal to the new born baby's body is expandable and the opposite side of each conduit is non-expandable, for example when: (1) increasing the precision of the pressure exerted on the newborn baby's body; (2) decreasing the overall form factor of the apparatus during operation; or (3) a combination thereof, is desirable. In some examples according to the present disclosure, each conduit is cylindrical, round or slot-shaped.

In the examples in which the transfer of fluid is used to expand each of the plurality of conduits, each of the plurality of conduits is made of any material that is at least partially expandable to apply a pressure on the newborn baby's body upon the transfer of fluid to the conduit. In some examples according to the present disclosure, each conduit is made of an elastomer, for example rubber, silicone, rubber or silicone like materials with elasticity and a Durometer Shore Harness between Shore 000 and Shore A40, skin safe and/or medical grade materials, or a combination thereof. In some examples according to the present disclosure, the side of each conduit proximal to the newborn baby's body is made of an elastomer with a lower resilience than and the opposite side of each conduit.

In the examples in which the application of an electric potential is used to expand each of the plurality of conduits, each of the plurality of conduits is made of a material that is at least partially expandable to apply a pressure on the newborn baby's body upon the application of electric potential to the conduit. In some examples according to the present disclosure, each conduit is made of a hybrid nanostructure comprising metal, for example a metal backbone that is interpenetrated by an electrolyte. In some examples according to the present disclosure, each conduit is made of Electrically Tuneable Materials, for example: (1) elastomer embedded with a sheet of low-melting-point Field's metal as a backbone and liquid-phase gallium-indium-tin (Galinstan R) alloy as the electrolyte; and (2) gold as the material and $HClO_4$ as the electrolyte.

In the examples in which a combination of: (1) the transfer of fluid; and (2) the application of an electric potential, is used to expand each of the plurality of conduits, at least a portion of each of the plurality of conduits is made of the herein described material that is at least partially expandable upon the transfer of fluid into the conduit and at least another portion of each of the plurality of conduits is made of the herein described material that is at least partially expandable upon the application of electric potential to the conduit.

In some examples according to the present disclosure, the pressure applying portion independent of the generated wave of pressure is at least one conduit of the plurality of conduits that substantially surround a portion of the newborn baby's body and expand independently to apply pressure along at least a portion of the newborn baby's body.

An apparatus defining a cavity for holding the newborn baby therein is any support structure that defines a hole that is sufficiently large to accommodate at least a portion of a newborn baby therein. In some examples according to the present disclosure, the cavity is of a sufficient size to accommodate the entire length of a newborn baby. In some examples according to the present disclosure, the cavity is of a sufficient size to accommodate at least 25%; at least 30%; at least 35%; at least 40%; at least 45%; at least 50%; at least 55%; at least 60%; at least 65%; at least 70%; at least 75%; at least 80%; at least 85%; at least 90%; at least 95%; 100%; or the percentage is between any one of the percentages listed above and any one of the other percentages listed above, of the length of a newborn baby. In some examples according to the present disclosure, the cavity is sufficiently large to accommodate at least the chest cavity of the newborn baby. In some examples according to the present disclosure, the cavity is sufficiently large to accommodate the entire newborn baby. In some examples according to the present disclosure, the apparatus defining a cavity is at least two adjoined cylindrical-shaped conduits.

The cavity may be from about 25 cm to about 80 cm deep, for example, about 25 cm; about 30 cm; about 35 cm; about 40 cm; about 45 cm; about 50 cm; about 55 cm; about 60 cm; about 65 cm; about 70 cm; about 75 cm; about 80 cm; or the depth is between any one of the depths listed above and any one of the other depths listed above. In some examples according to the present disclosure, the circumference of at least a portion of the cavity is from about 20 cm to about 70 cm, for example, about 20 cm; about 25 cm; about 30 cm; about 35 cm; about 40 cm; about 45 cm; about 50 cm; about 55 cm; about 60 cm; about 65 cm; about 70 cm; or the circumference is between any one of the circumferences listed above and any one of the other circumferences listed above.

The apparatus may be made of any material that is: (1) sufficiently durable to support a newborn baby's weight; (2) sufficiently rigid to support the expansion of a plurality of conduits; (3) medical grade; or (4) a combination thereof. In some examples according of the present disclosure, the apparatus defining a cavity is made of a medical grade silicone rubber.

The apparatus may further comprise an exterior shell that is coupled to the side of each expandable conduit opposite to the side of each conduit that is proximal to the newborn baby's body. The exterior shell may be made of any material that is: (1) sufficiently rigid to support the expansion of a plurality of conduits; (2) medical grade; (3) sufficiently less elastic than the plurality of conduits to oppose the force created by the expansion of the plurality of conduits; or (4) a combination thereof. In some examples according to the present disclosure, the exterior shell is made of a metal material, a composite material, or a plastic material. In some examples according to the present disclosure, the material is a fabric or netting.

The apparatus may further comprise an interior shell that is coupled to the side of each expandable conduit proximal to the newborn baby's body and directly contacts the newborn baby's body. The interior shell may be made of any material that is: (1) medical grade; (2) sufficiently flexible to accommodate a plurality of conduits at different expansion states; or (3) a combination thereof. In some examples according to the present disclosure, the interior shell is made of a medical grade polymer. In some examples according to the present disclosure, the interior shell and/or the plurality of conduits is coated with a skin lubricant.

In some examples according to the present disclosure, the distal pressure applying portion is an expandable bladder. The expandable bladder is any sac that is expandable: (1) on transfer of fluid into the bladder; (2) on application of an electric potential to the bladder; or (3) a combination thereof, and applies pressure to the distal end of the newborn baby held in the cavity. The: (1) expandability; (2) size; and (3) shape of the bladder may vary provided that the bladder applies a sufficient pressure to the distal end of the newborn baby's body to move the newborn baby along its axis of length.

In the examples in which the transfer of fluid is used to expand the bladder, the bladder is made of any material that is at least partially expandable to apply a pressure to the distal end of the newborn baby's body to move the newborn baby along its axis of length upon the transfer of fluid to the bladder. In some examples according to the present disclosure, the bladder is made of an elastomer, for example rubber, silicone, rubber or silicone like materials with elasticity and a Durometer Shore Harness between Shore 000 and Shore A40, skin safe and/or medical grade materials, or a combination thereof. In some examples according to the present disclosure, the side of the bladder proximal to the new born baby's body is made of an elastomer with a lower resilience than and the opposite side of the bladder.

In the examples in which the application of an electric potential is used to expand the bladder, the bladder is made of any material that is at least partially expandable to apply a pressure to the distal end of the newborn baby's body to move the newborn baby along its axis of length upon the application of electric potential to the bladder. In some examples according to the present disclosure, the bladder is made of a hybrid nanostructure comprising metal, for example a metal backbone that is interpenetrated by an electrolyte. In some examples according to the present disclosure, each conduit is made of Electrically Tuneable Materials, for example: (1) elastomer embedded with a sheet of low-melting-point Field's metal as a backbone and liquid-phase gallium-indium-tin (Galinstan R) alloy as the electrolyte; and (2) gold as the material and $HClO_4$ as the electrolyte.

In the examples in which a combination of: (1) the transfer of fluid; and (2) the application of an electric potential, is used to expand the bladder, at least a portion of the bladder is made of the herein described material that is at least partially expandable upon the transfer of fluid to the bladder and at least another portion of the bladder is made of the herein described material that is at least partially expandable upon the application of electric potential to the bladder.

The apparatus may further comprise an exterior shell that couples to the side of the bladder opposite to the side of the bladder that is proximal to the newborn baby's body. The apparatus may further comprise an interior shell that is coupled to the side of the bladder proximal to the newborn baby's body and directly contacts the newborn baby's body.

In some examples according to the present disclosure, the distal pressure applying portion is more than one expandable bladder. At least a portion of the more than one expandable bladder may be oriented in overlapping layers, for example, when: (1) increasing the volume of expansion of the expandable bladder(s); (2) increasing the pressure on the newborn baby; or (3) a combination therefor, is desirable. In some examples according to the present disclosure, each expandable bladder orientated in overlapping layers is independently expandable on: (1) transfer of fluid from a fluid source into the expandable bladder (2) application of an electric potential from an electric potential source to the expandable bladder; or (3) a combination thereof.

Expandable on transfer of fluid into the bladder refers to providing a sufficient amount of fluid into the bladder to cause at least a portion of the bladder to expand outwardly from the center of the bladder in an unexpanded state. The fluid is any flowable substance that can be transferred into a conduit and cause the bladder to expand. In some examples according to the present disclosure, the fluid is liquid or gas. In some examples according to the present disclosure, the fluid is liquid, for example when: (1) increasing temperature control; (2) decreasing compression compared to air which may allow greater control of the pressure applied; or (3) a combination thereof, is desirable.

Expandable on application of an electric potential to the bladder refers to providing sufficient electric potential from an electric potential source to the bladder to cause at least a portion of the bladder to expand outwardly from the center of the bladder in an unexpanded state. In some examples according to the present disclosure, the bladder is made of a hybrid nanostructure comprising metal, for example a metal backbone that is interpenetrated by an electrolyte. An electric potential source refers to any energy source that converts one type of energy into electric energy, for example, an electrochemical cell. In some examples according to the present disclosure, the applied electric potential to the bladder may be from about 0.0001 V to about 100 V, for example, about 0.0001 V; about 0.0005 V; about 0.0010 V; about 0.0050 V; about 0.0100 V; about 0.0500 V; about 0.1000 V; about 0.5000 V; about 1.0000 V; about 2.0000 V; about 3.0000 V; about 4.0000 V; about 5.0000 V; about 6.0000 V; about 7.0000 V; about 8.0000 V; about 9.0000 V; about 10.0000 V; about 15.0000 V; 20.0000 V; 25.0000 V; 50.0000 V; 75.0000 V; 100.0000 V; or the electric potential is between any one of the electric potentials listed above and any one of the other electric potentials listed above. Preferably, the electric potential is less than about 10.0000 V.

Expandable with a combination of: (1) the transfer of fluid into the bladder; and (2) the application of an electric potential to the bladder, refers to providing a sufficient amount of fluid from a fluid source into the bladder to cause at least a portion of the bladder to expand outwardly from the center of the bladder in an unexpanded state and providing sufficient electric potential from an electric potential source to the bladder to cause at least another portion of the bladder to expand outwardly from the center of the bladder in an unexpanded state. In some examples according to the present disclosure, the at least another portion of the bladder, upon application of an electric potential source, expands and becomes more rigid thereby impeding further expansion at the at least another portion while the at least a portion of the bladder, upon transfer of fluid therein, continues to expand.

Each of the plurality of pressure applying portions and the distal pressure applying portion may be activated independently. In some examples according to the present disclosure, each of the pressure applying portions and the distal pressure applying portion are coupled to a single source of activation. In other examples according to the present disclosure, each of the pressure applying portions and the distal pressure applying portions are coupled to separate sources of activation.

In the examples in which the transfer of fluid is used, a single source of activation may be a pump that is coupled to each of the plurality of conduits and the expandable bladder via an operable valve, or valve controller, that controls the amount of fluid that enters each of the plurality of conduits and the expandable bladder. In some examples according to the present disclosure, each of the plurality of conduits, the expandable bladder, and the operable valves are in communication with a processor configured to control the amount of fluid transferred into each of the plurality of conduits and the expandable bladder. In some examples according to the present disclosure, each of the plurality of conduits and the expandable bladder are coupled to a pressure sensor to measure the pressure applied by each of the plurality of conduits and the expandable bladder on a newborn baby's body. In some examples according to the present disclosure, the processor is in communication with the pressure sensor and is configured to monitor and adjust the pressure of each of the plurality of conduits and the expandable bladder based on the measured pressure. In some examples according to the present disclosure, the processor is user controlled. In other examples according to the present disclosure, the processor is controlled by an algorithm. In some examples according to the present disclosure, coupling is provided by any tube-like structure that allows the flow of fluid therethrough.

In the examples in which the application of an electric potential is used, a single source of activation may be an electric potential controller that is in electrical communication with each of the plurality of conduits and the expandable bladder. The electric potential controller controls the electrical potential applied to each of the plurality of conduits and the expandable bladder. In some examples according to the present disclosure, each of the plurality of conduits, the expandable bladder, and the electric potential controller are in communication with a processor configured to control the electrical potential applied to each of the plurality of conduits and the expandable bladder. In some examples according to the present disclosure, each of the plurality of conduits and the expandable bladder are coupled to a pressure sensor to measure the pressure applied by each of the plurality of conduits and the expandable bladder on a newborn baby's body. In some examples according to the present disclosure, the processor is in communication with the pressure sensor and is configured to monitor and adjust the pressure of each of the plurality of conduits and the expandable bladder based on the measured pressure. In some examples according to the present disclosure, the processor is user controlled. In other examples according to the present disclosure, the processor is controlled by an algorithm. In some examples according to the present disclosure, coupling is provided by any component that allows the flow of electrons therethrough, for example, copper wire.

In the examples in which a combination of: (1) the transfer of fluid; and (2) the application of an electric potential is used, a combination of the herein described single sources of activation may be implemented.

In some examples according to the present disclosure, the volume of the newborn baby may be determined before the pressure applying portions generate a wave of pressure along the newborn baby's body and/or before the distal pressure portion generates a pressure at the distal end of the newborn baby. In some examples according to the present disclosure, the plurality of conduits and the expandable bladder are expanded until they contact, directly or indirectly, the newborn baby's body, and the processor is configured to determine the three-dimensional space that the newborn baby occupies in the apparatus based on the amount of expansion of the plurality of conduits and the expandable bladder.

FIGS. 1A-D illustrate one example of an apparatus according to the present disclosure. The apparatus (100) defines a cavity (102) for holding the newborn baby therein (not shown). The apparatus comprises two expandable conduits (104) that each surround the cavity (102). Each conduit is independently expandable on transfer of fluid from a fluid source (now shown) into the conduit (104) to apply pressure along at least a portion of the length of the newborn baby (not shown) held in the cavity (102). The two expandable conduits are in an unexpanded state.

Figure 2A:
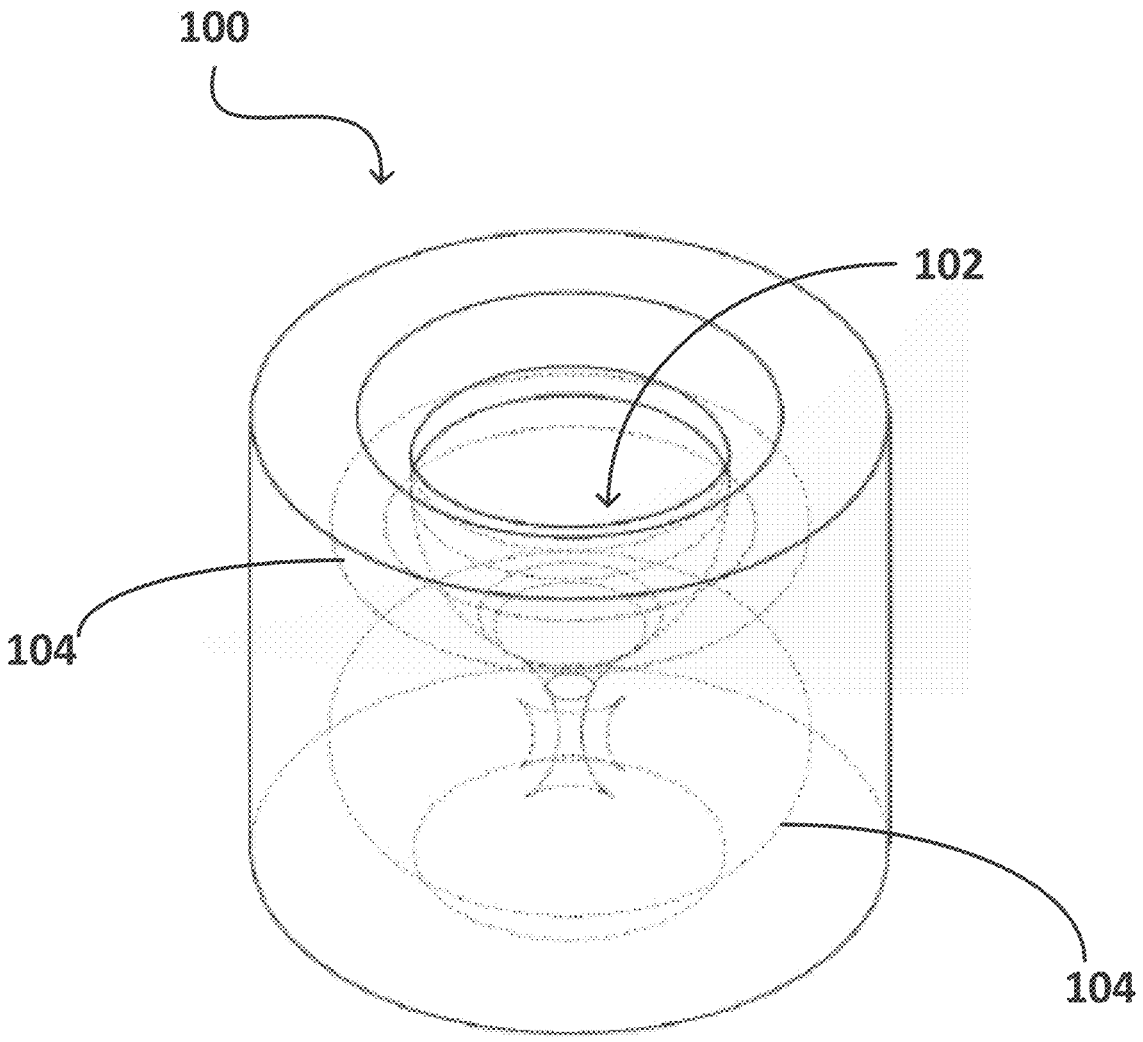
FIGS. 2A-B are illustrations of the apparatus illustrated in FIGS. 1A-D in perspective views where one of the expandable conduits is in an expanded state.
Figure 2B:
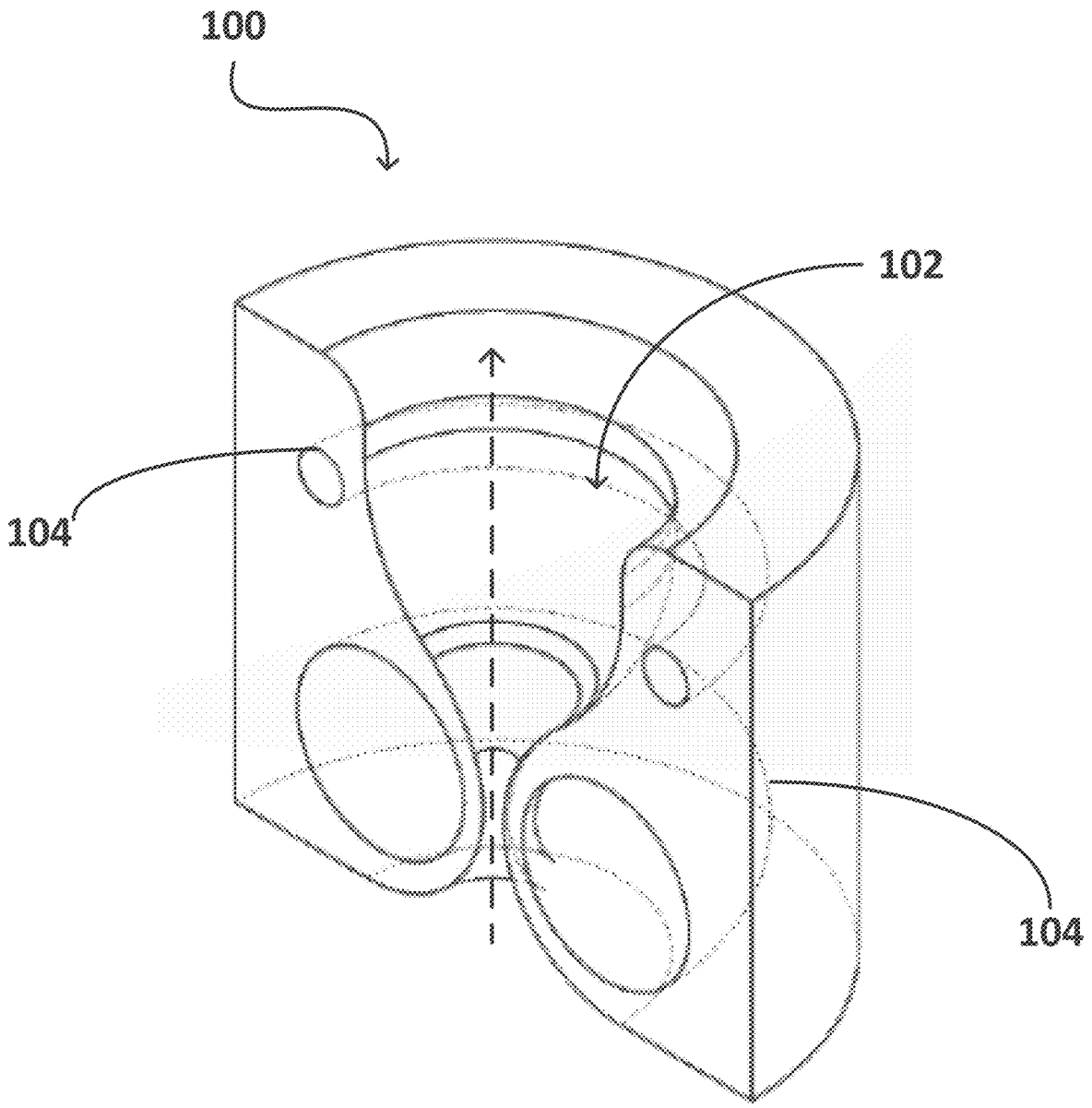
Figure 3A:
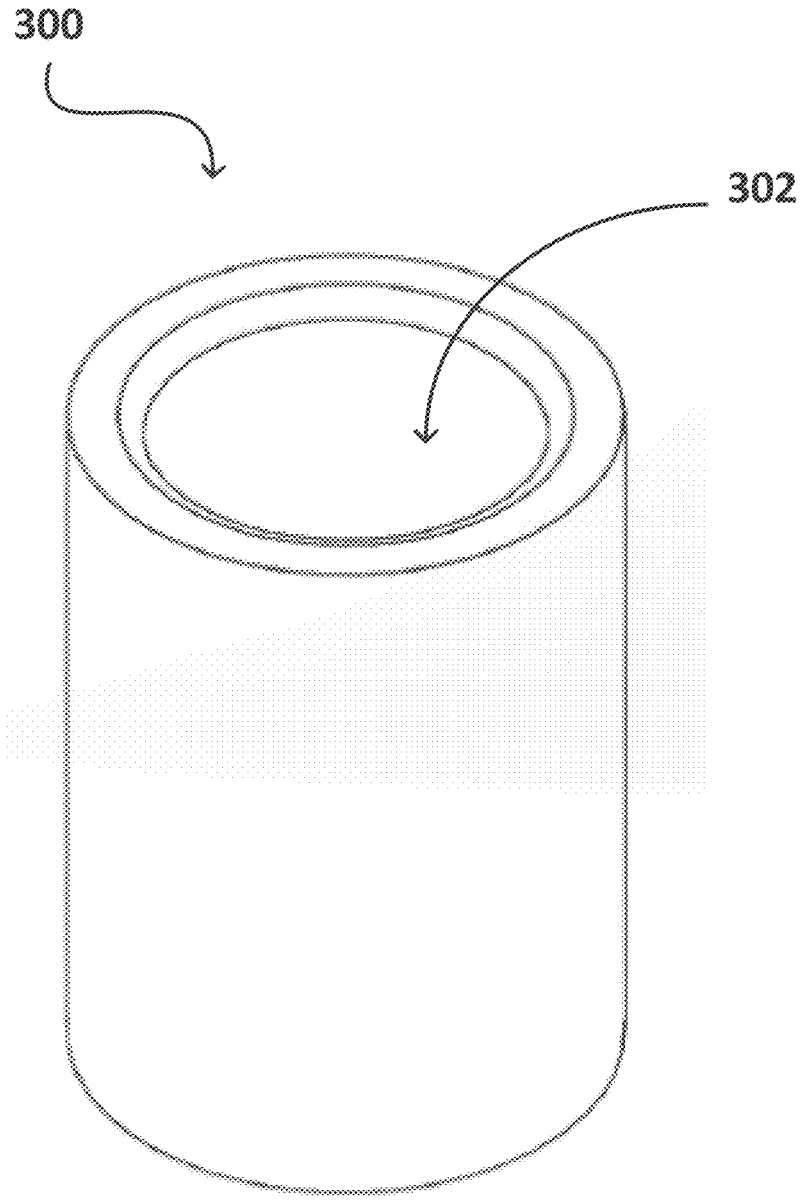
Figure 3B:
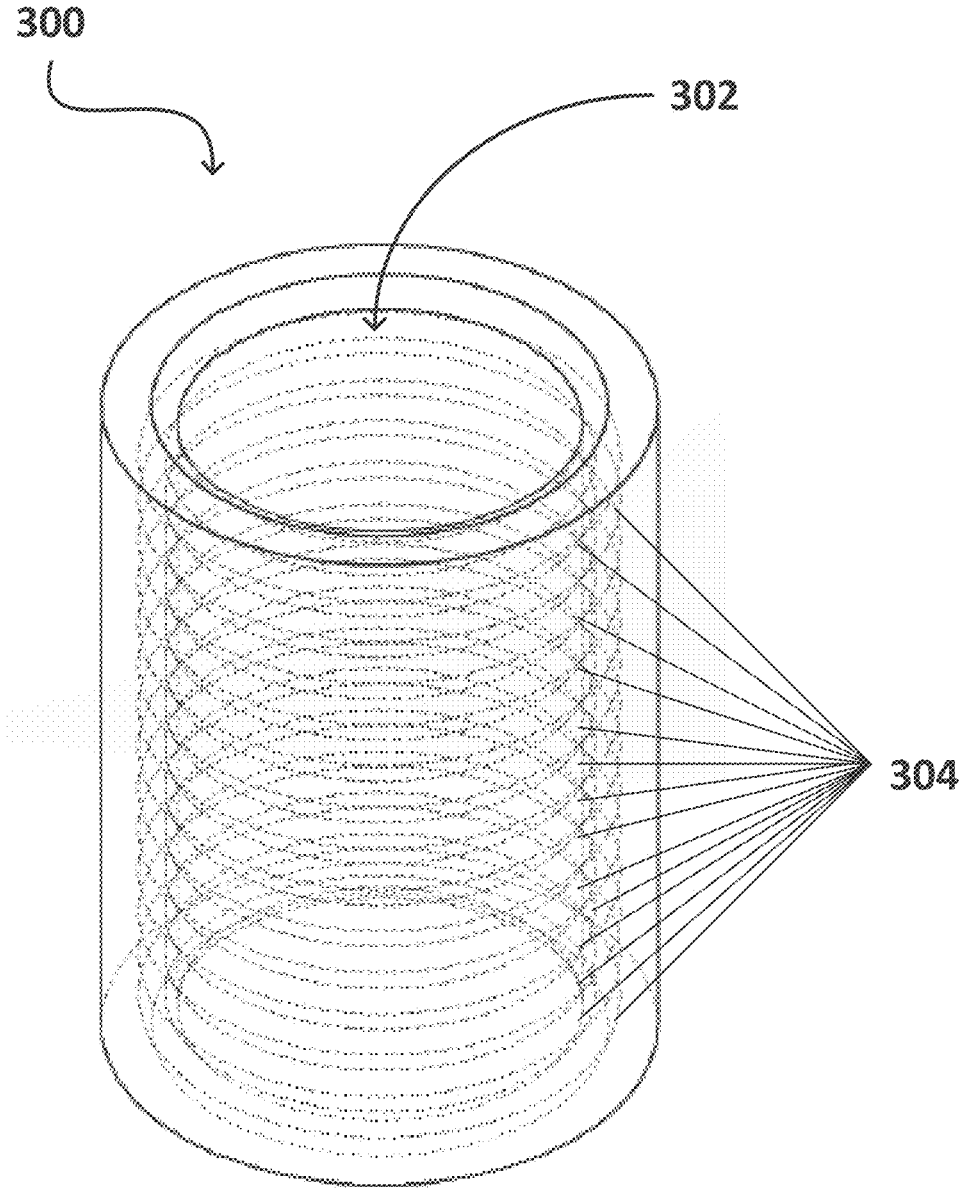
Figure 3D:
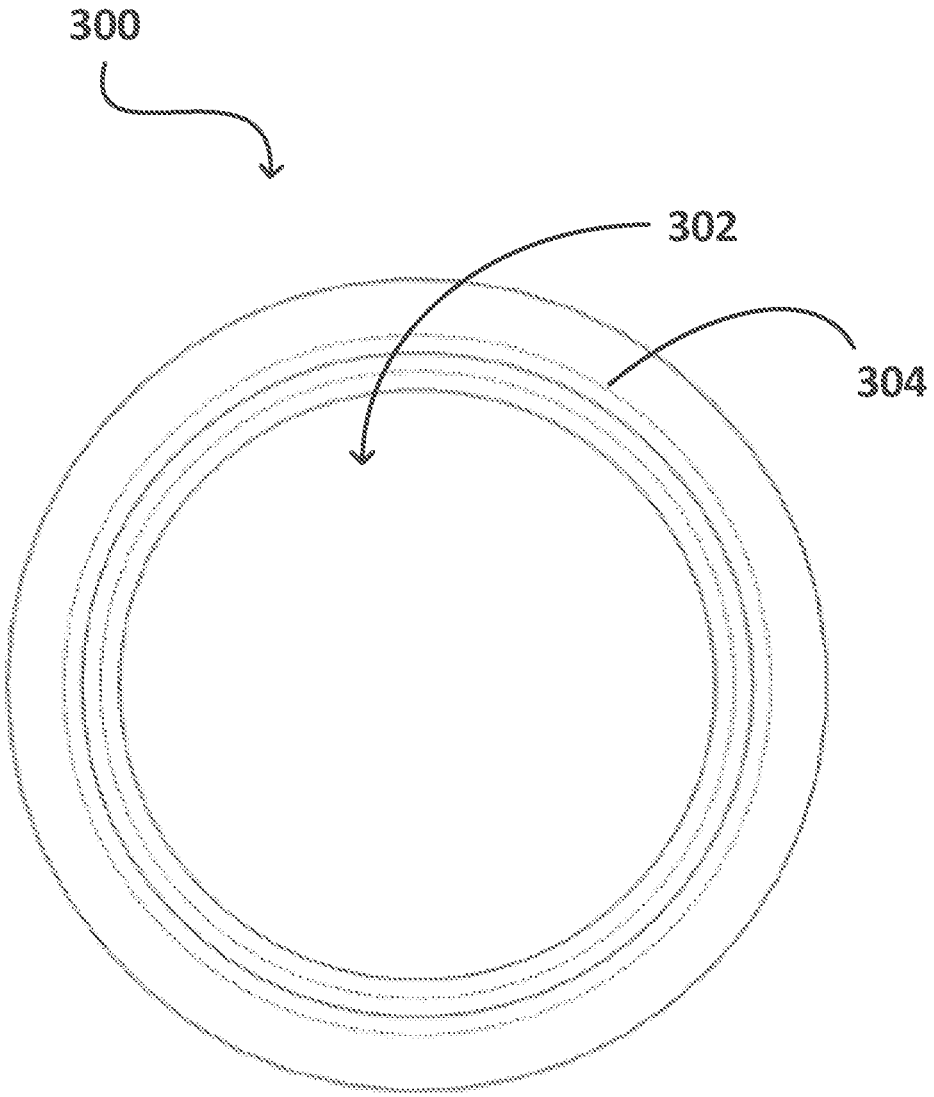
Figure 3D:
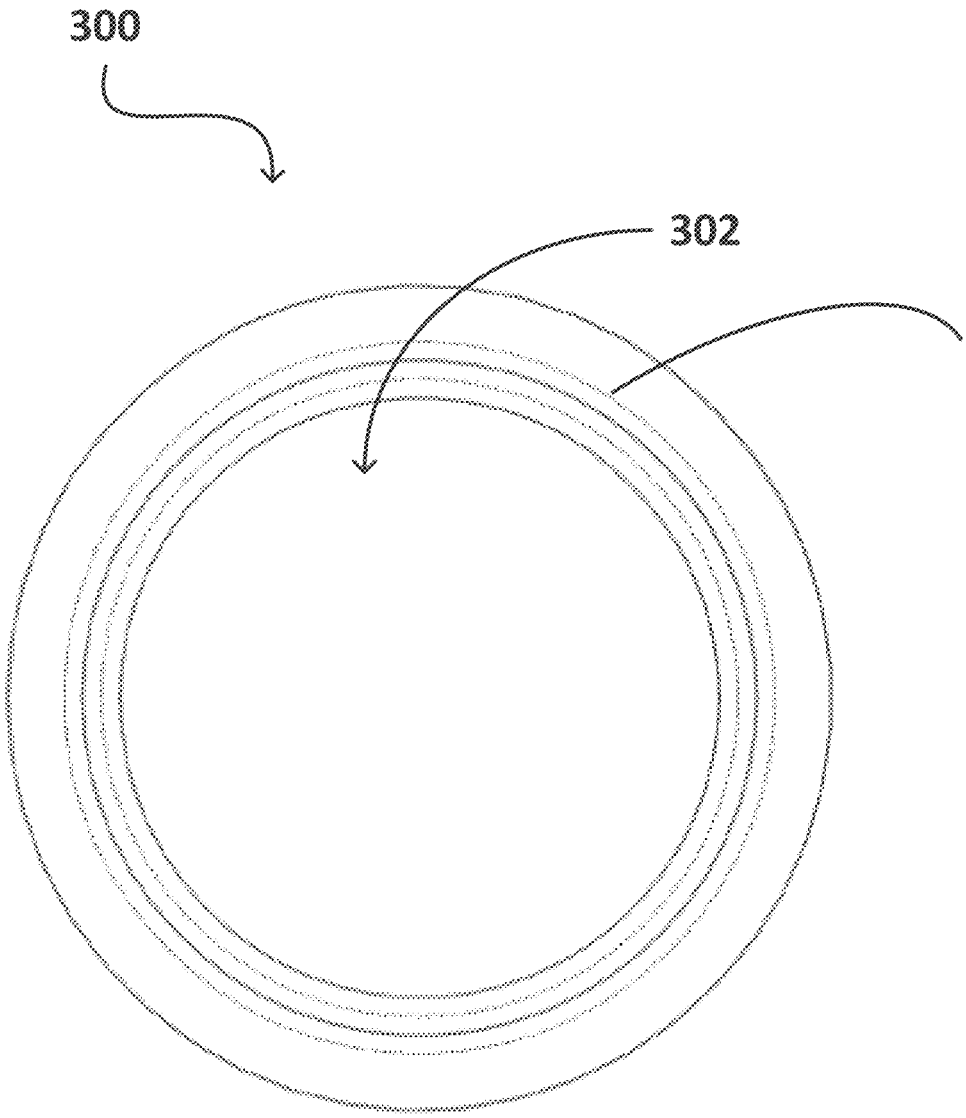

FIGS. 2A-B illustrate the apparatus illustrated in FIGS. 1A-D where one of the expandable conduits (104) is in an expanded state.

FIGS. 3A-D illustrate another example of an apparatus according to the present disclosure. The apparatus (300) defines a cavity (302) for holding the newborn baby therein (not shown). The apparatus comprises 14 expandable conduits (304) that each surround the cavity (302). Each conduit is independently expandable on transfer of fluid from a fluid source (now shown) into the conduit (304) to apply pressure along at least a portion of the length of the newborn baby (not shown) held in the cavity (302). The 14 expandable conduits are in an unexpanded state.

Figure 4A:
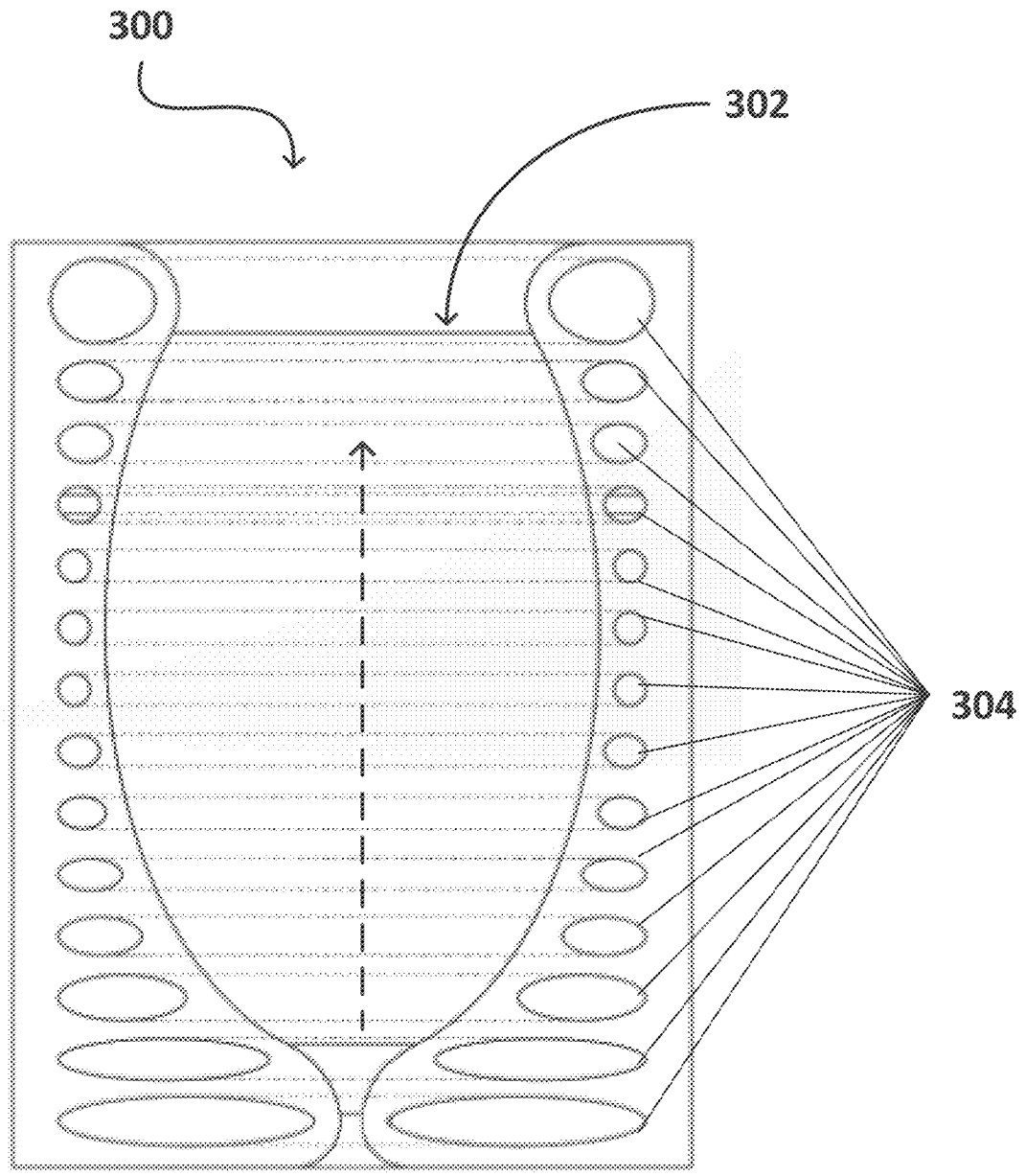
FIGS. 4A-C are illustrations of the apparatus illustrated in FIGS. 3A-D in a planar cross-sectional view (FIG. 4A), a perspective view (FIG. 4B), and a perspective cross-sectional view (FIG. 4C).
Figure 4B:
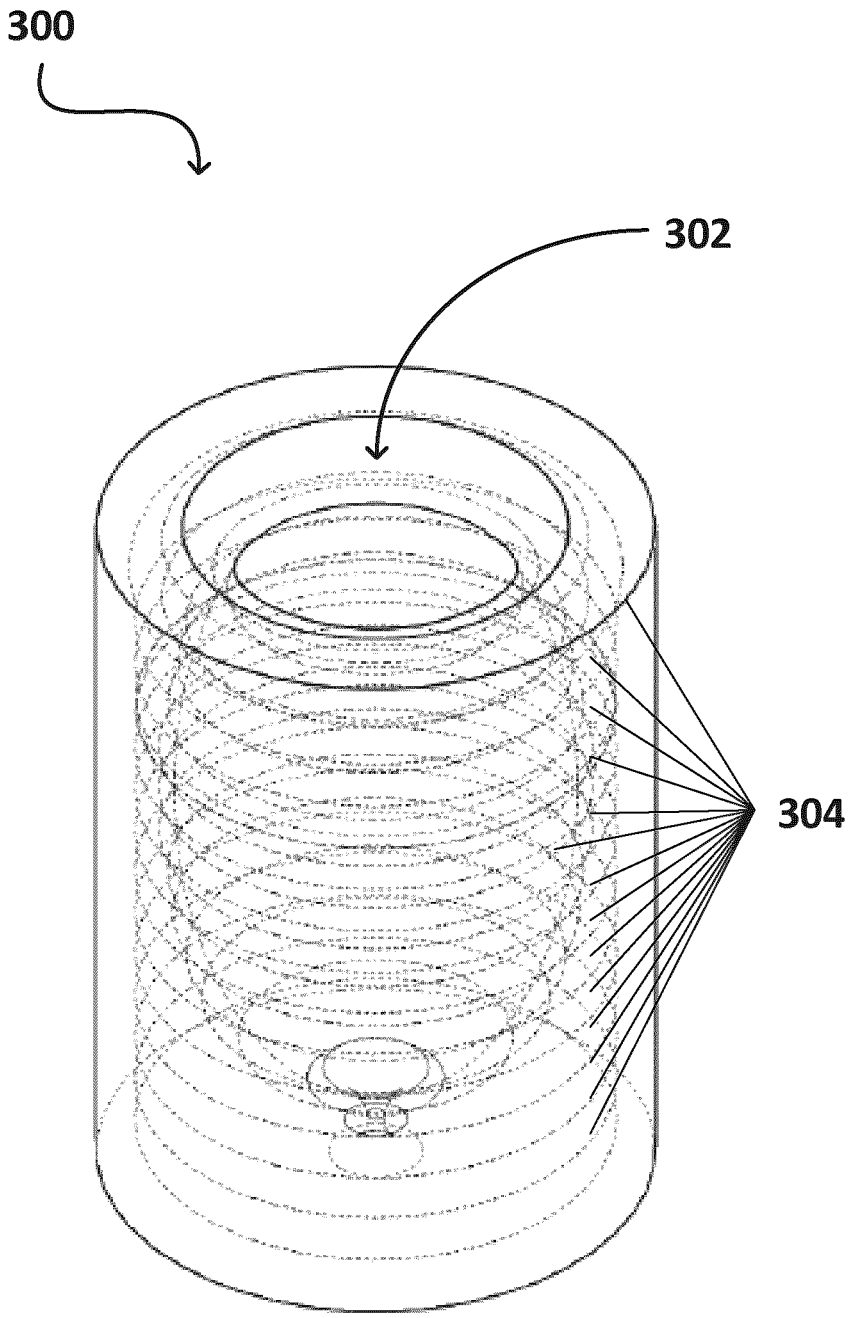
Figure 4C:
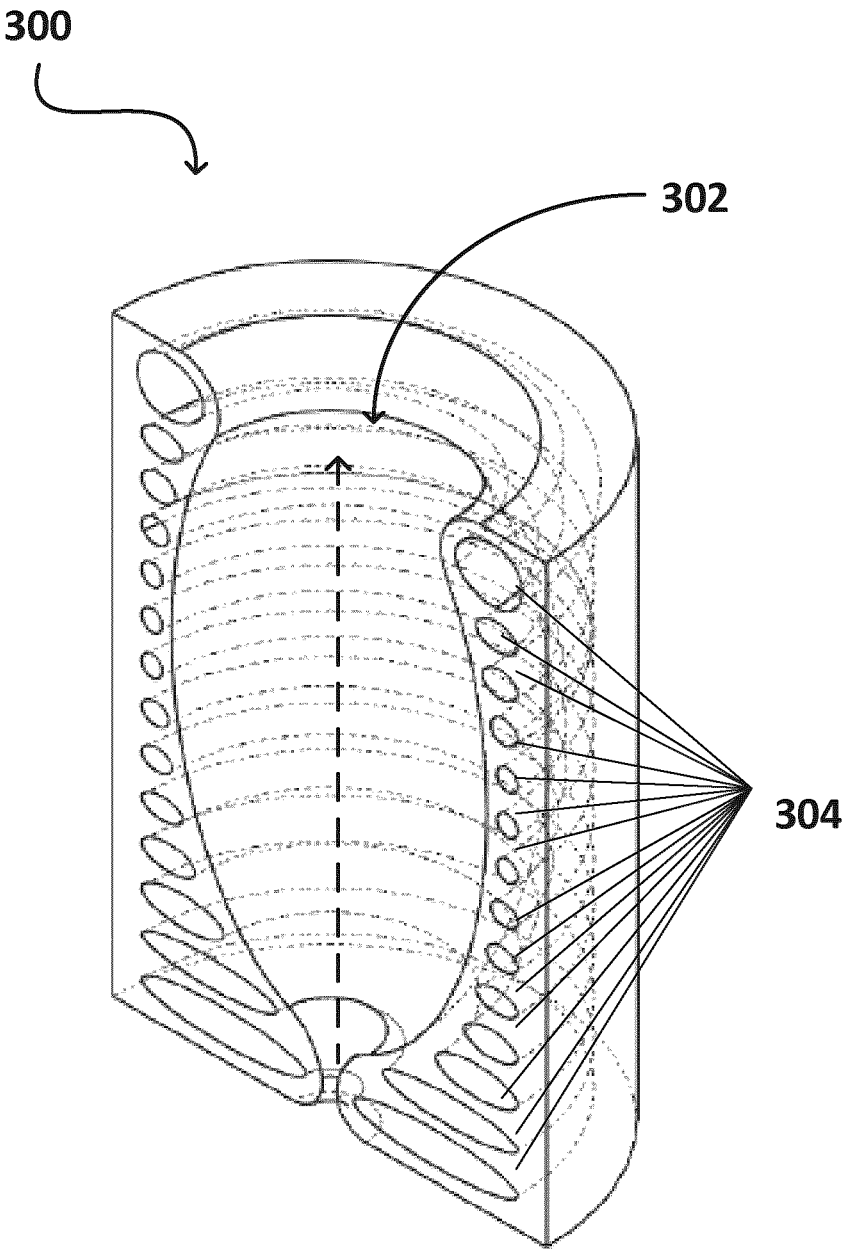

FIGS. 4A-C illustrate the apparatus illustrated in FIGS. 3A-D where some of the conduits (304) are in an expanded state at assorted degrees of expansion generating a wave of pressure, and some of the conduits (304) are in an unexpanded state.

Figure 5A:
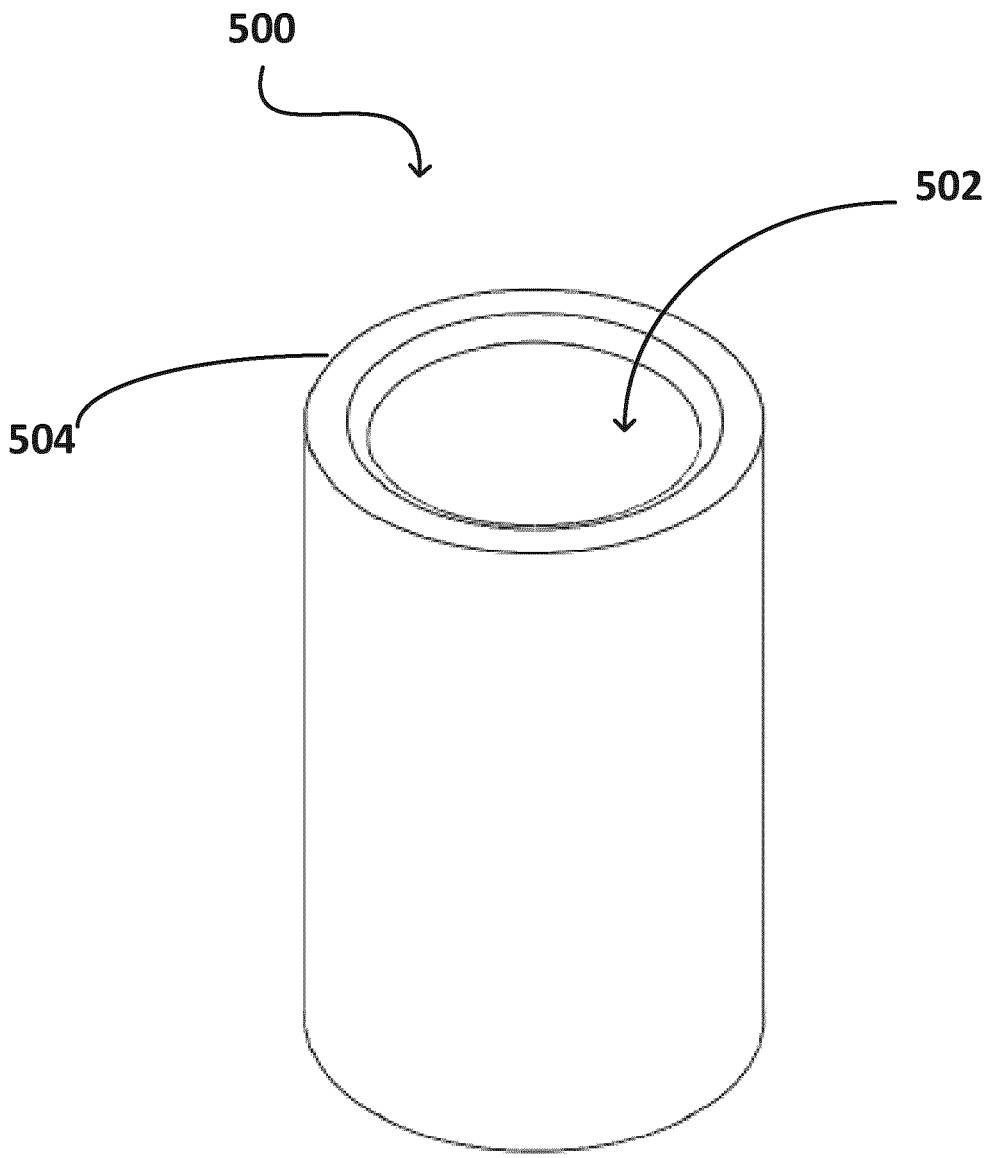
FIGS. 5A-C are illustrations of another example of an apparatus according to the present disclosure in perspective views (FIGS. 5A and B), and a perspective cross-sectional view (FIG. 5C). The dashed arrow illustrates the axis of length of the newborn baby.
Figure 5B:
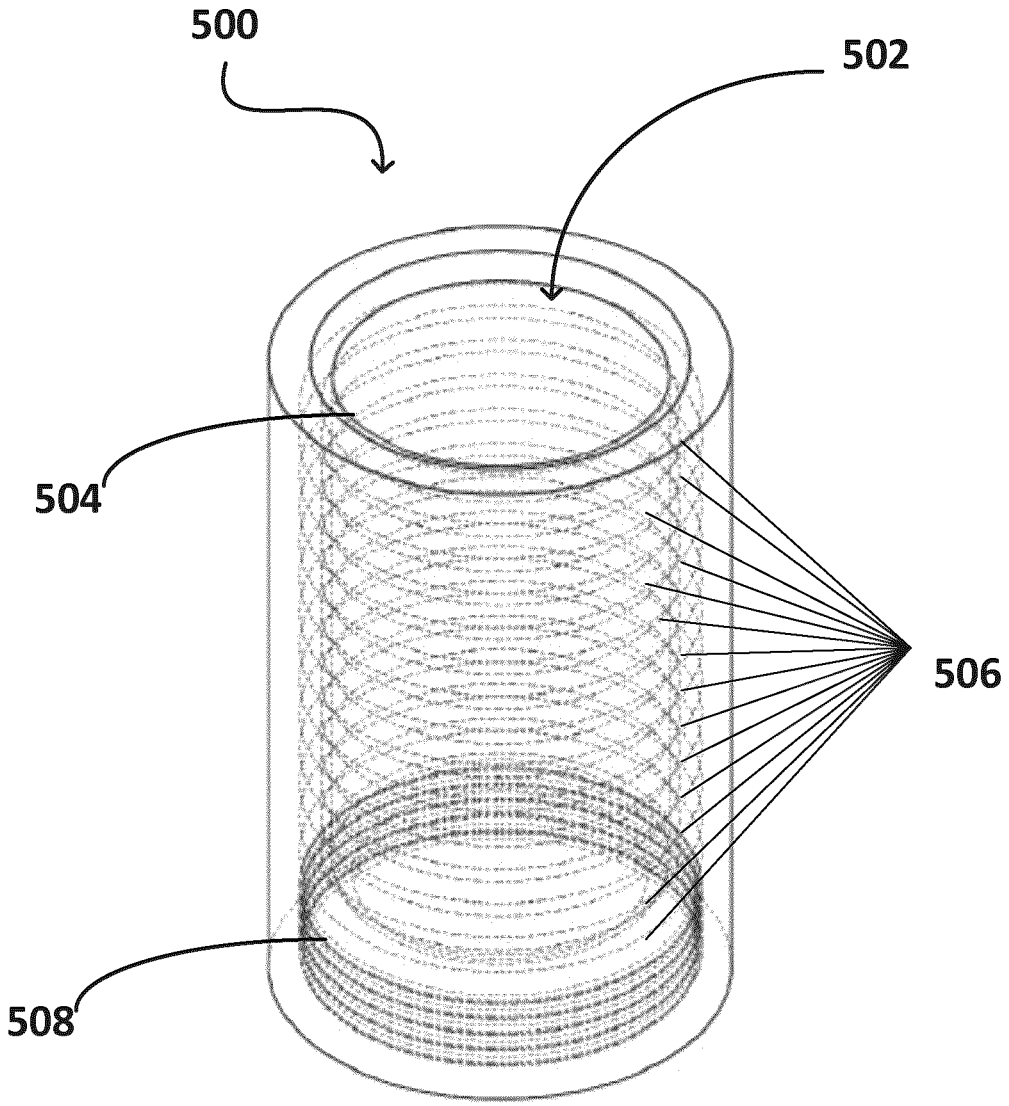
Figure 5C:
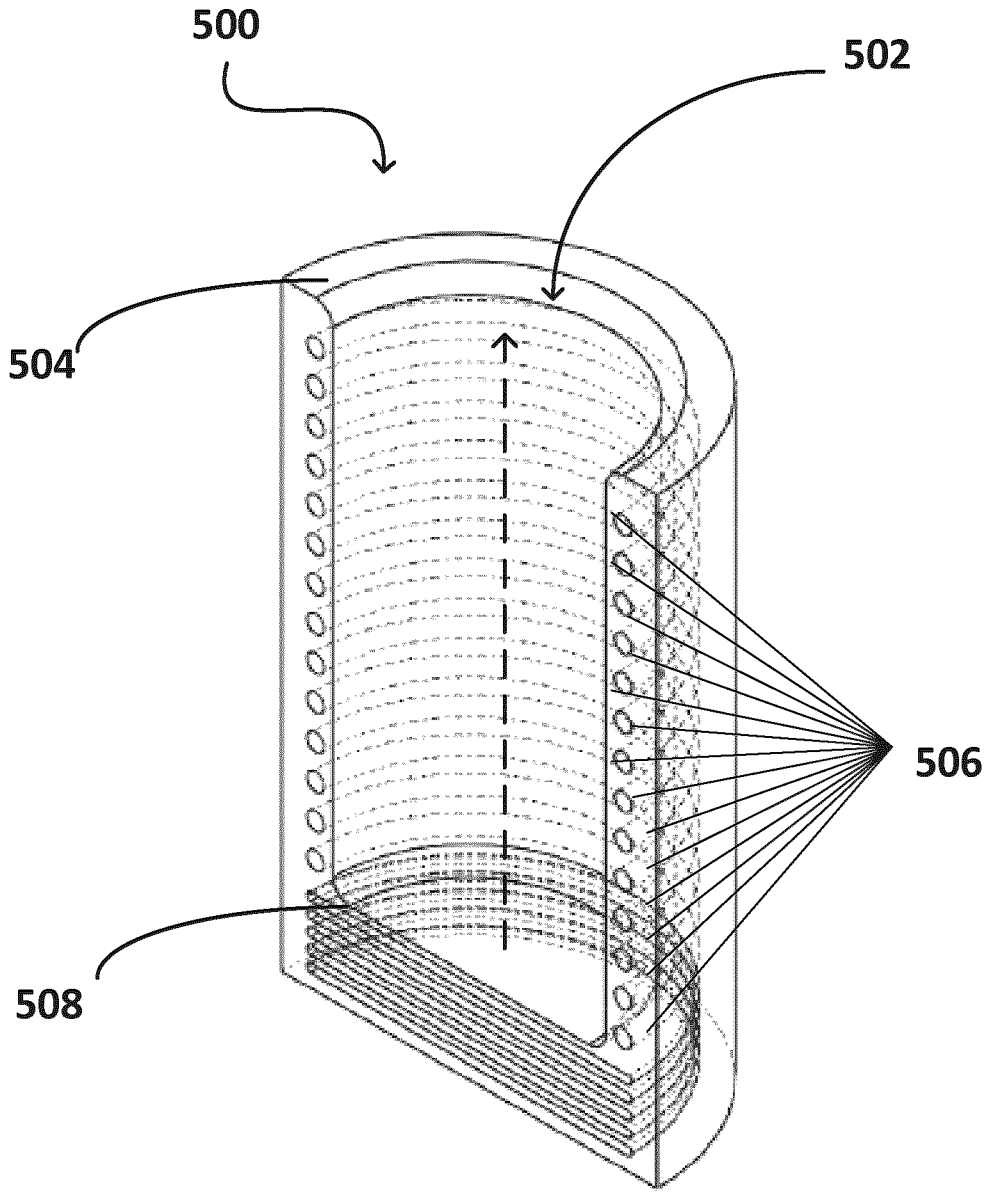

FIGS. 5A-C illustrate another example of an apparatus according to the present disclosure. The apparatus (500) defines a cavity (502) for holding the newborn baby therein (not shown) and has an open end (504) for inserting the newborn baby (not shown) into the cavity (502). The apparatus comprises 14 expandable conduits (506) that each surround the cavity (502). Each conduit is independently expandable on transfer of fluid from a fluid source (now shown) into the conduit (506) to apply pressure along at least a portion of the length of the newborn baby (not shown) held in the cavity (502). The 14 expandable conduits are in an unexpanded state. The apparatus (500) also comprises an expandable bladder (508) opposite the open end (504) that is connected to a fluid source (not shown) and expandable on transfer of fluid from the fluid source into the bladder (508) to apply pressure to the distal end of the newborn baby (not shown) held in the cavity (502). The expandable bladder (508) is in an unexpanded state.

Figure 6A:
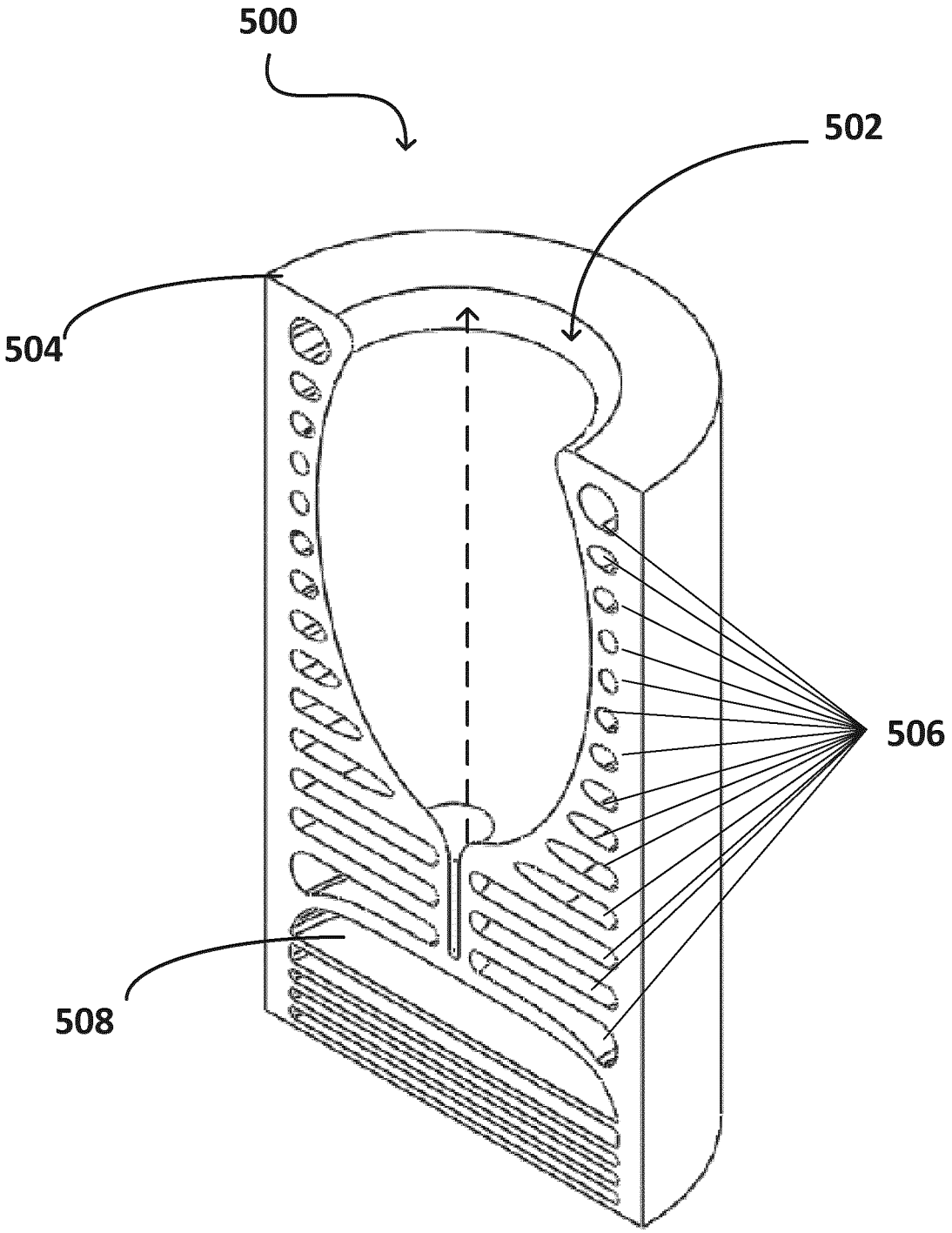
FIGS. 6A-B are illustrations of the apparatus illustrated in FIGS. 5A-C in perspective cross-sectional views.
Figure 6B:
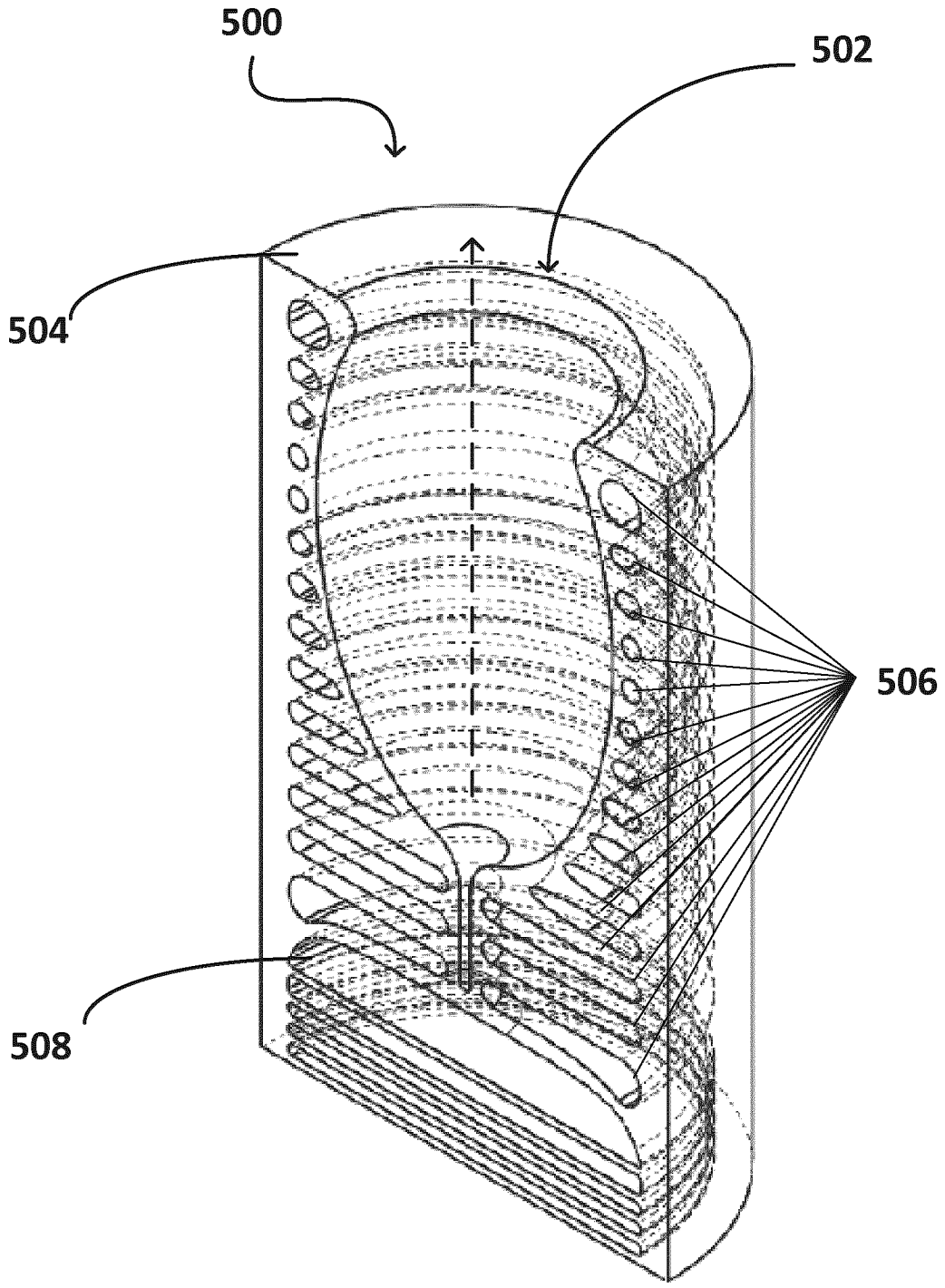

FIGS. 6A-B illustrate the apparatus illustrated in FIGS. 5A-D where some of the conduits (506) are in an expanded state at assorted degrees of expansion generating a wave of pressure, and some of the conduits (506) are in an unexpanded state, and the bladder (508) is in an expanded state.

Figure 7A:
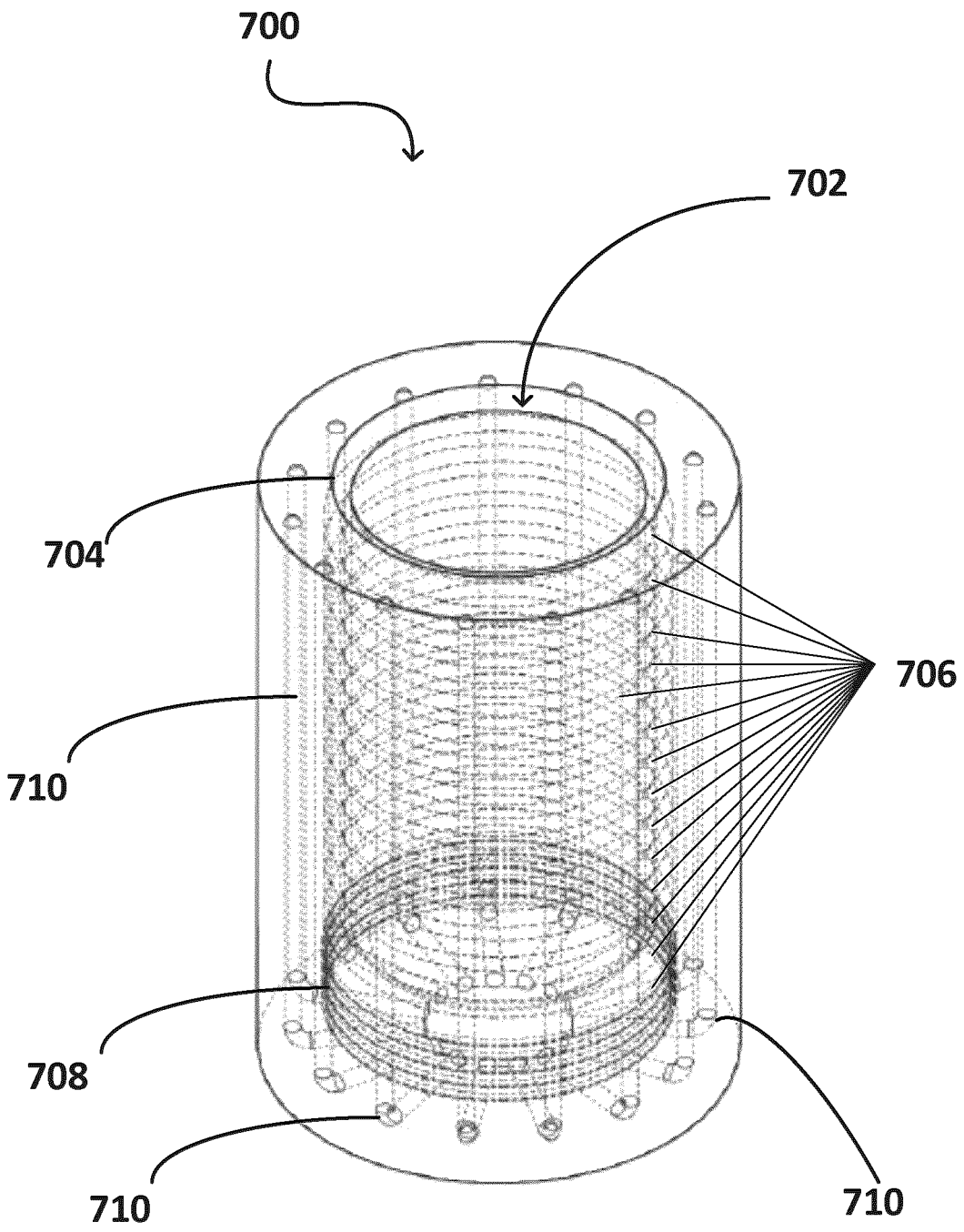
FIGS. 7A-C are illustrations of another example of an apparatus according to the present disclosure in a perspective view (FIG. 7A), a perspective cross-sectional view (FIG. 7B), and a planar top view (FIG. 7C). The dashed arrow illustrates the axis of length of the newborn baby.
Figure 7B:
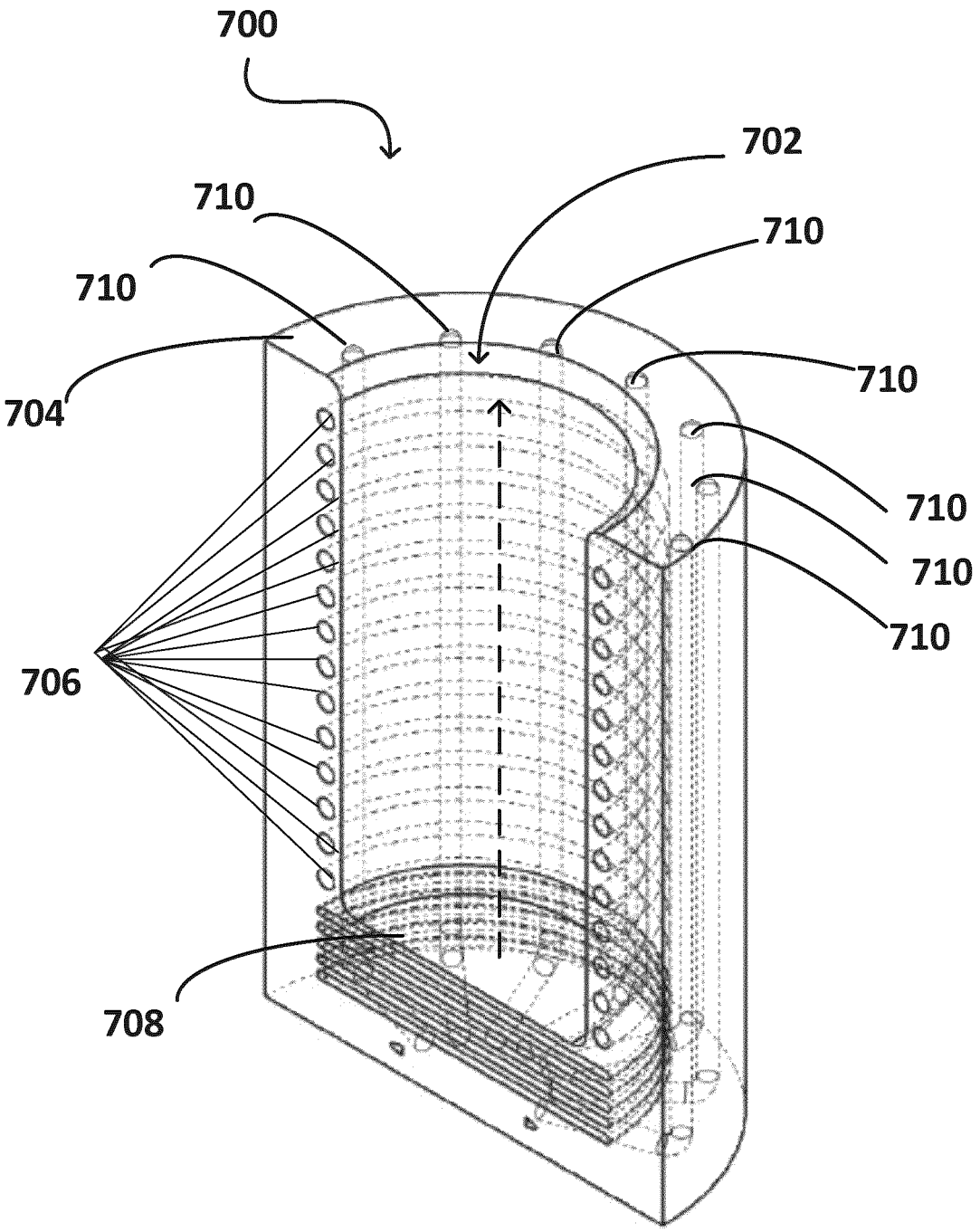
Figure 7C:
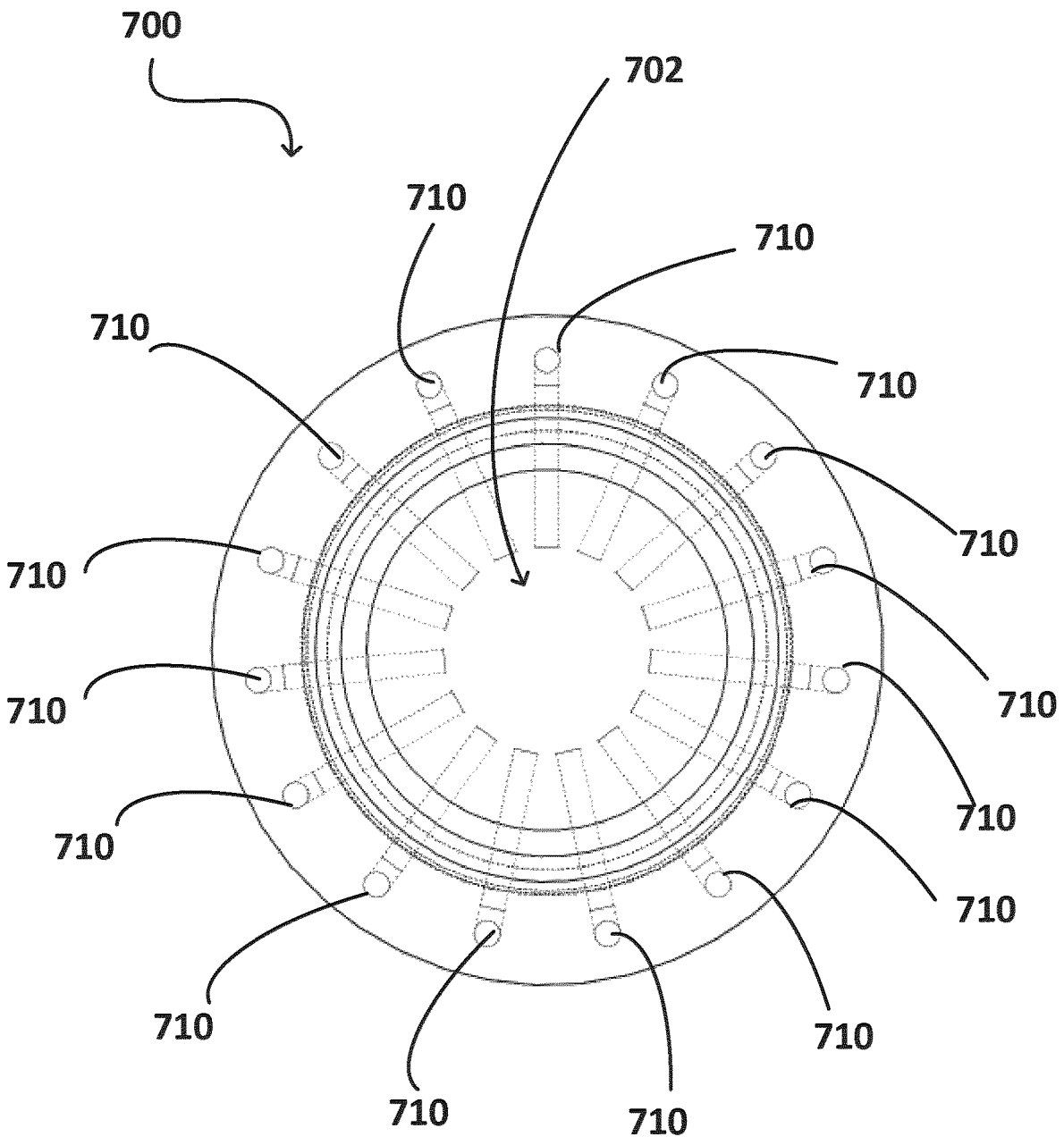

FIGS. 7A-C illustrate another example of an apparatus according to the present disclosure. The apparatus (700) defines a cavity (702) for holding the newborn baby therein (not shown) and has an open end (704) for inserting the newborn baby (not shown) into the cavity (702). The apparatus comprises 14 expandable conduits (706) that each surround the cavity (702). Each conduit is independently expandable on transfer of fluid from a fluid source (now shown) into the conduit (706) to apply pressure along at least a portion of the length of the newborn baby (not shown) held in the cavity (702). The 14 expandable conduits are in an unexpanded state. The apparatus (700) also comprises an expandable bladder (708) opposite the open end (704) that is connected to a fluid source (now shown) and expandable on transfer of fluid from the fluid source into the bladder (708) to apply pressure to the distal end of the newborn baby (not shown) held in the cavity (702). The expandable bladder (708) is in an unexpanded state. The apparatus (700) further comprises a tube system (710) coupled to the plurality of conduits (706) and the expandable bladder (708) for transferring fluid therethrough.

Figure 8A:
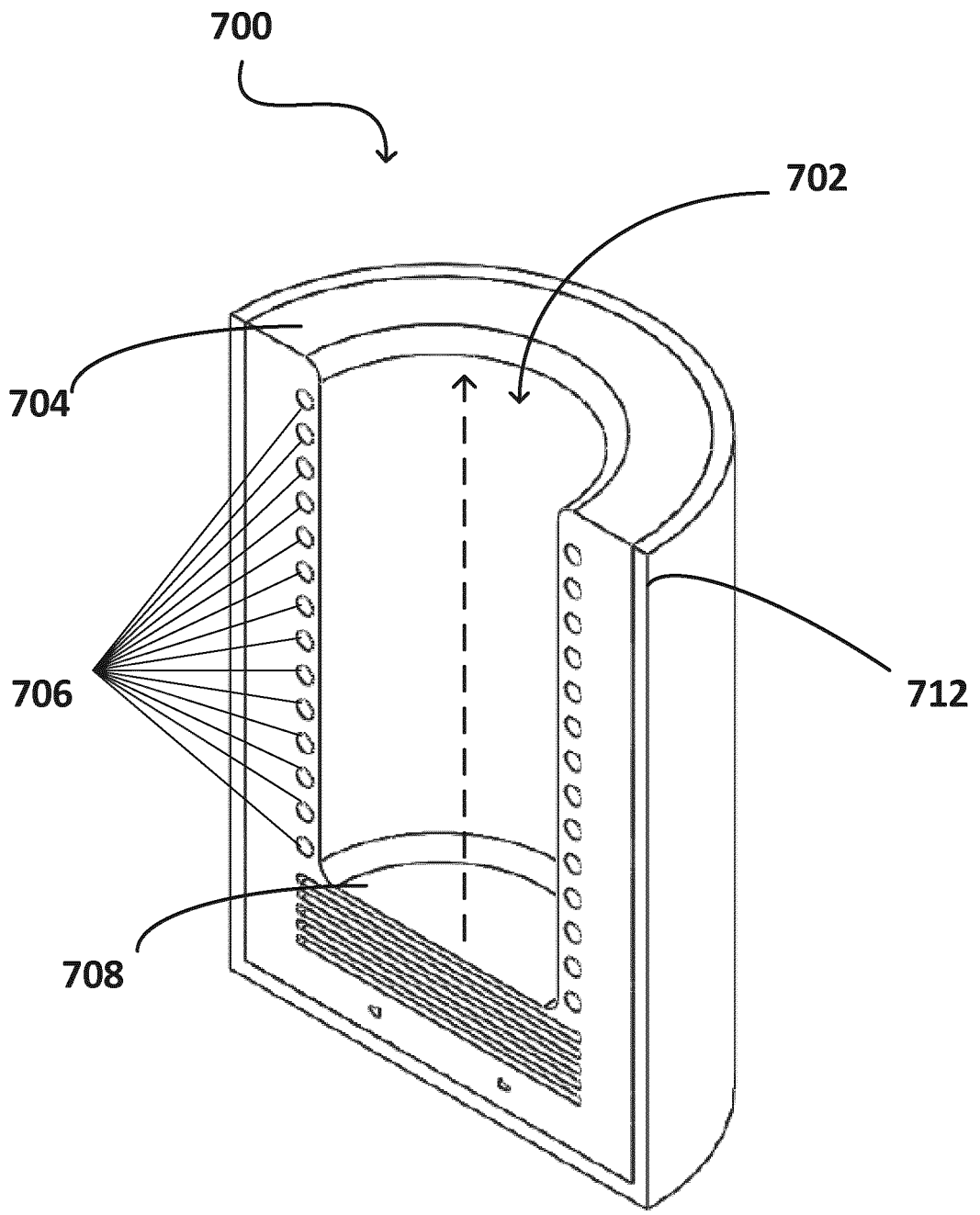
FIGS. 8A-C are illustrations of the apparatus illustrated in FIGS. 7A-C further comprising an exterior shell in perspective cross-sectional views (FIGS. 8A and B), and a planar top view (FIG. 8C).
Figure 8B:
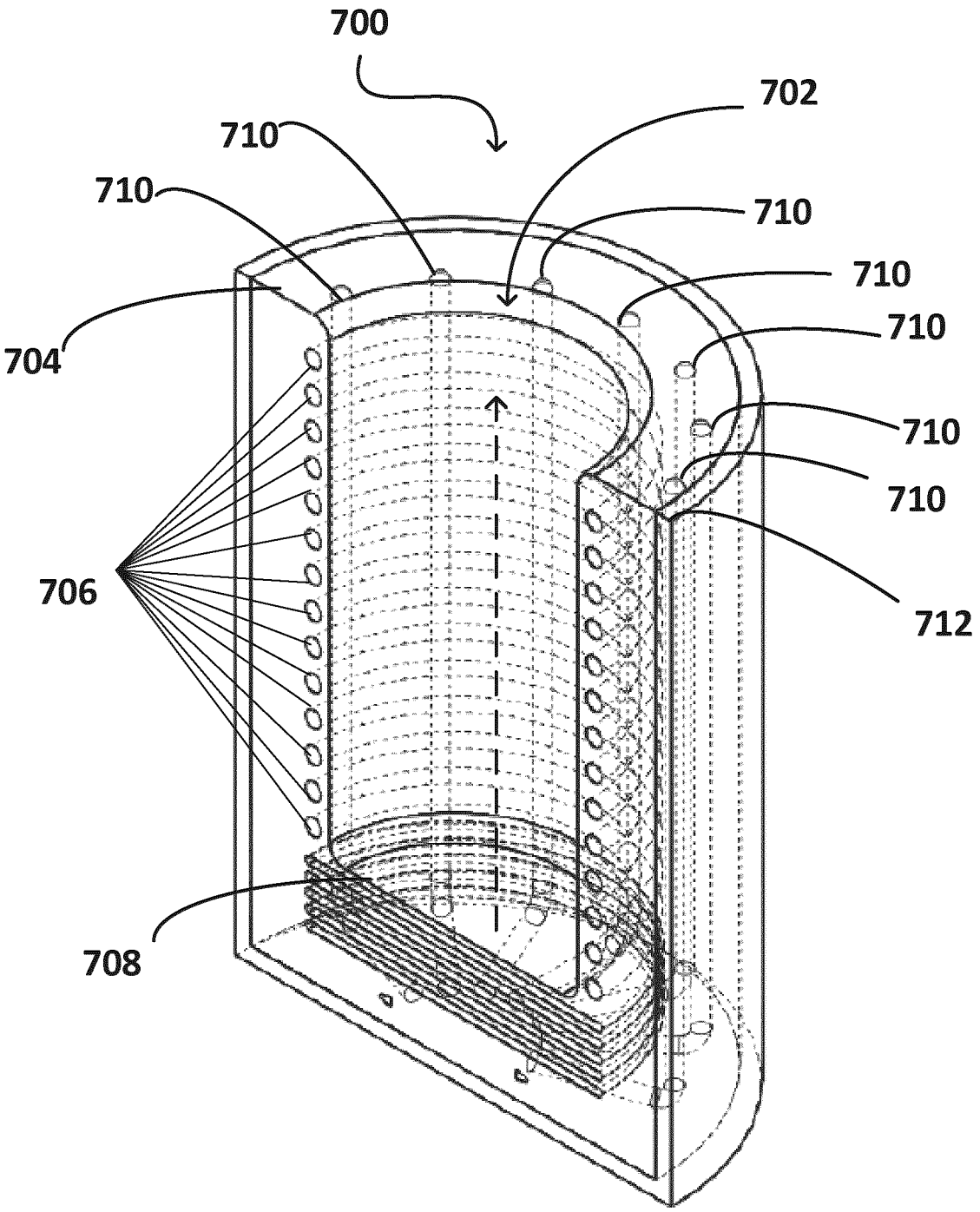
Figure 8C:
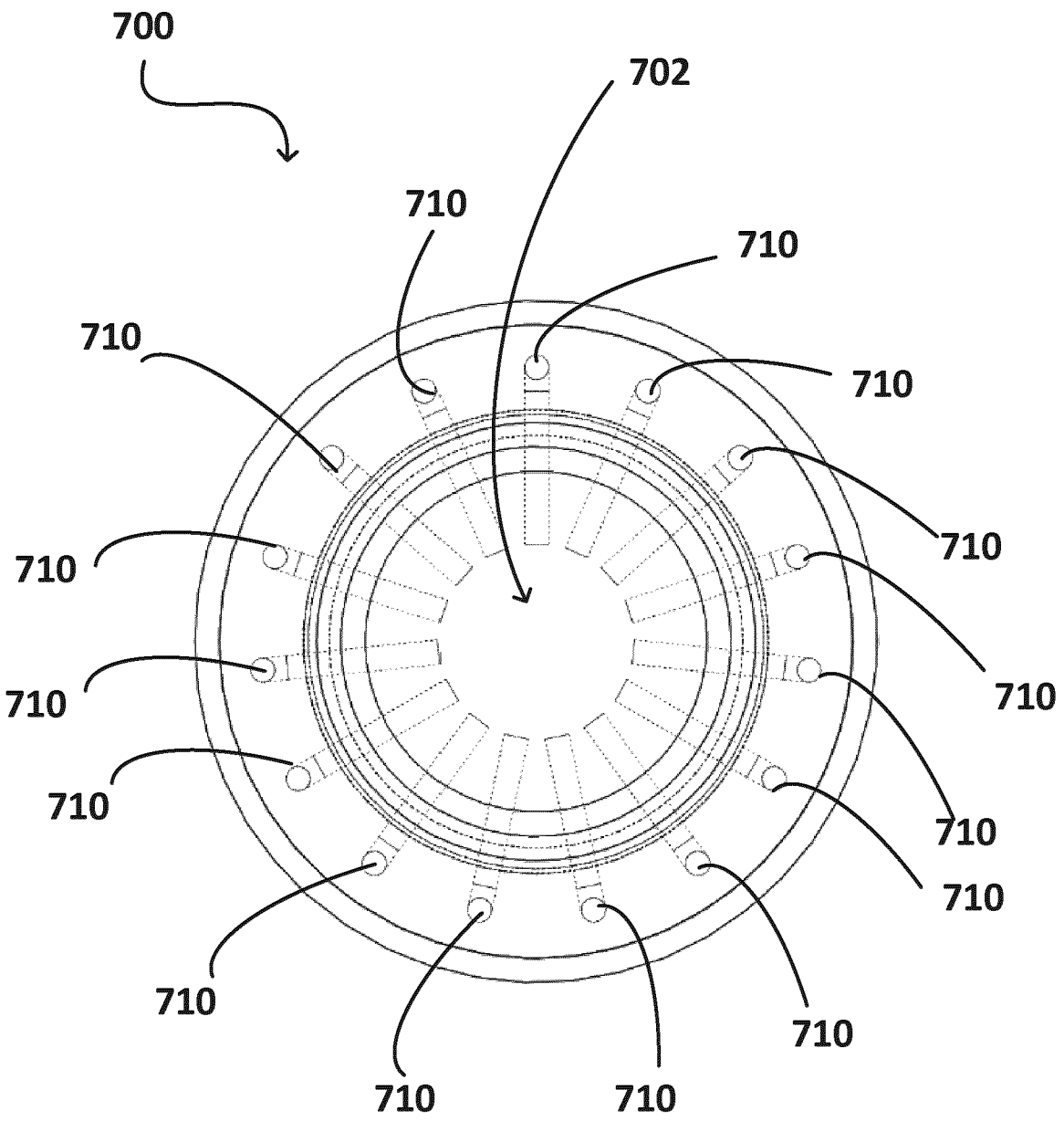
Figure 9A:
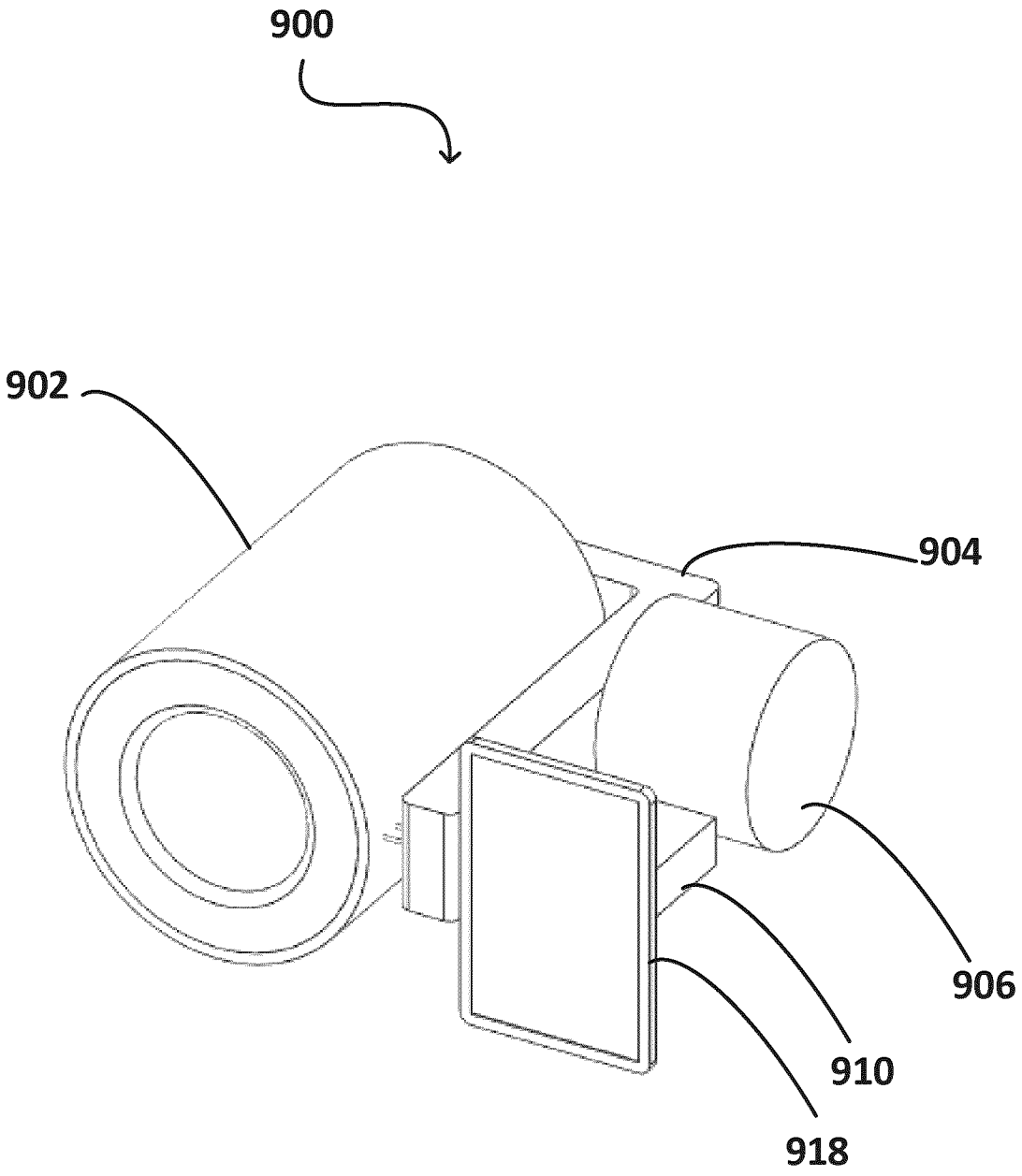
FIGS. 9A-E are illustrations of an example of a system according to the present disclosure in perspective views (FIGS. 9A and B), a perspective cross-sectional view (FIG. 9C), and planar cross-sectional views (FIGS. 9D and E).
Figure 9B:
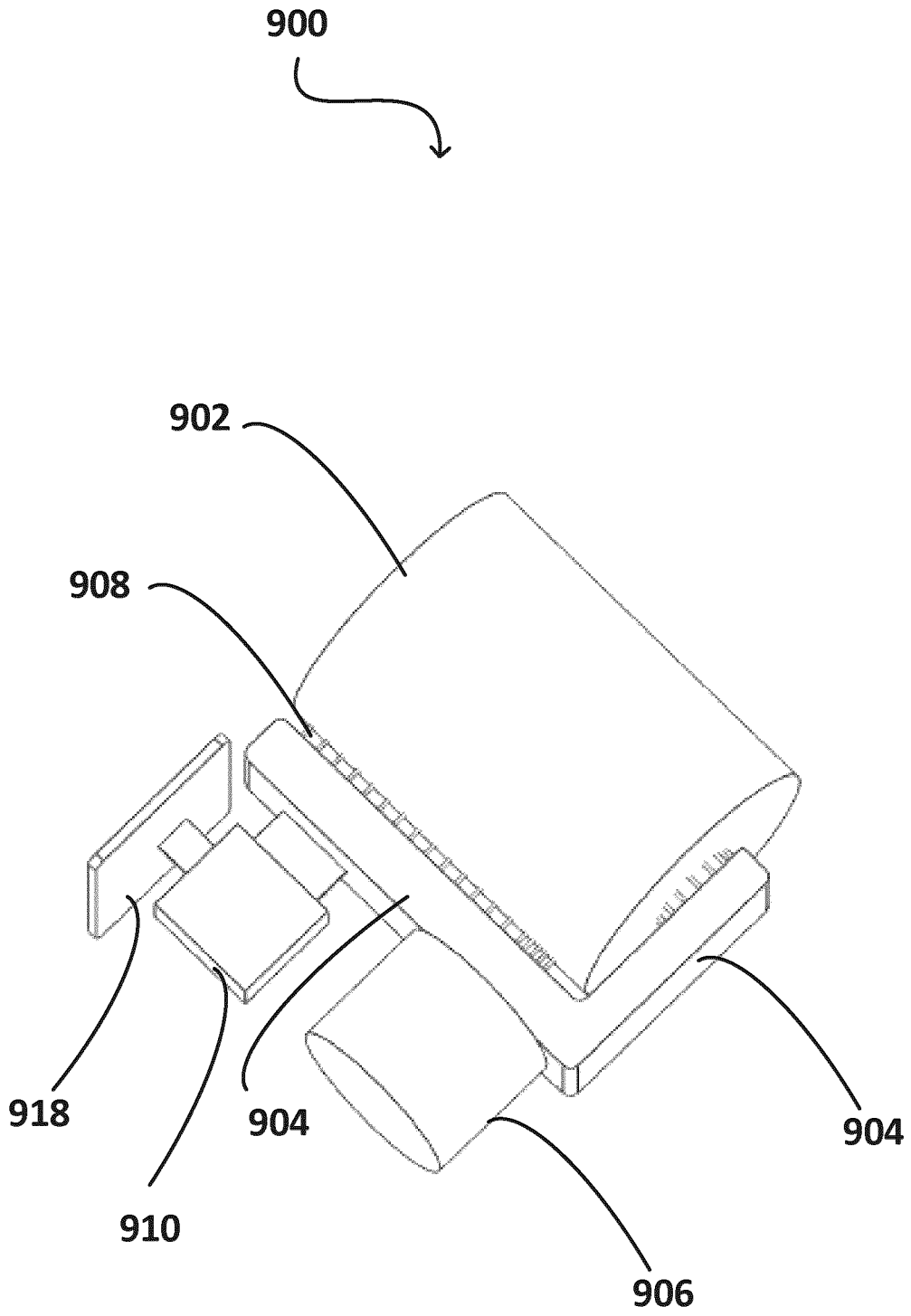
Figure 9C:
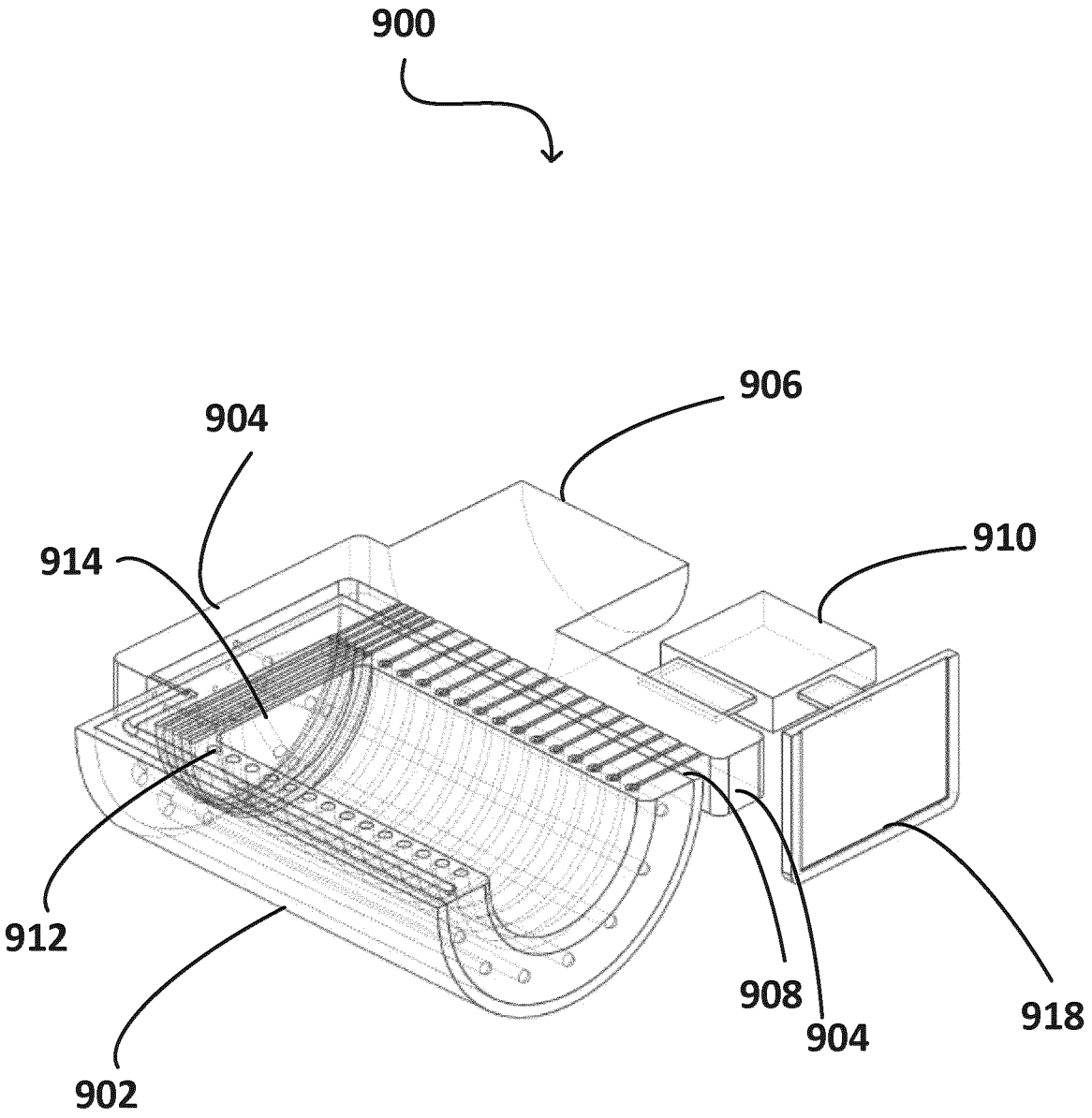
Figure 9D:
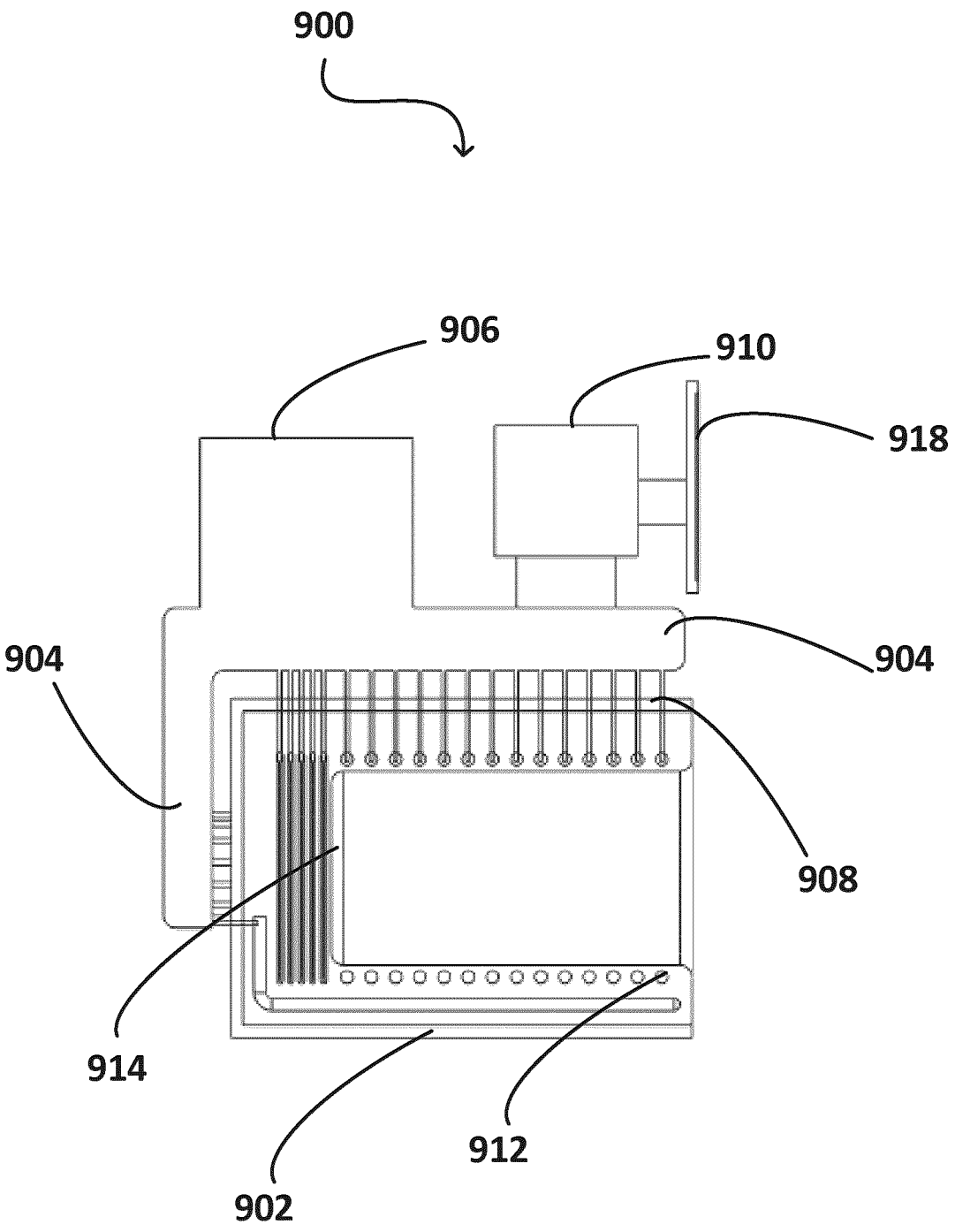
Figure 9E:
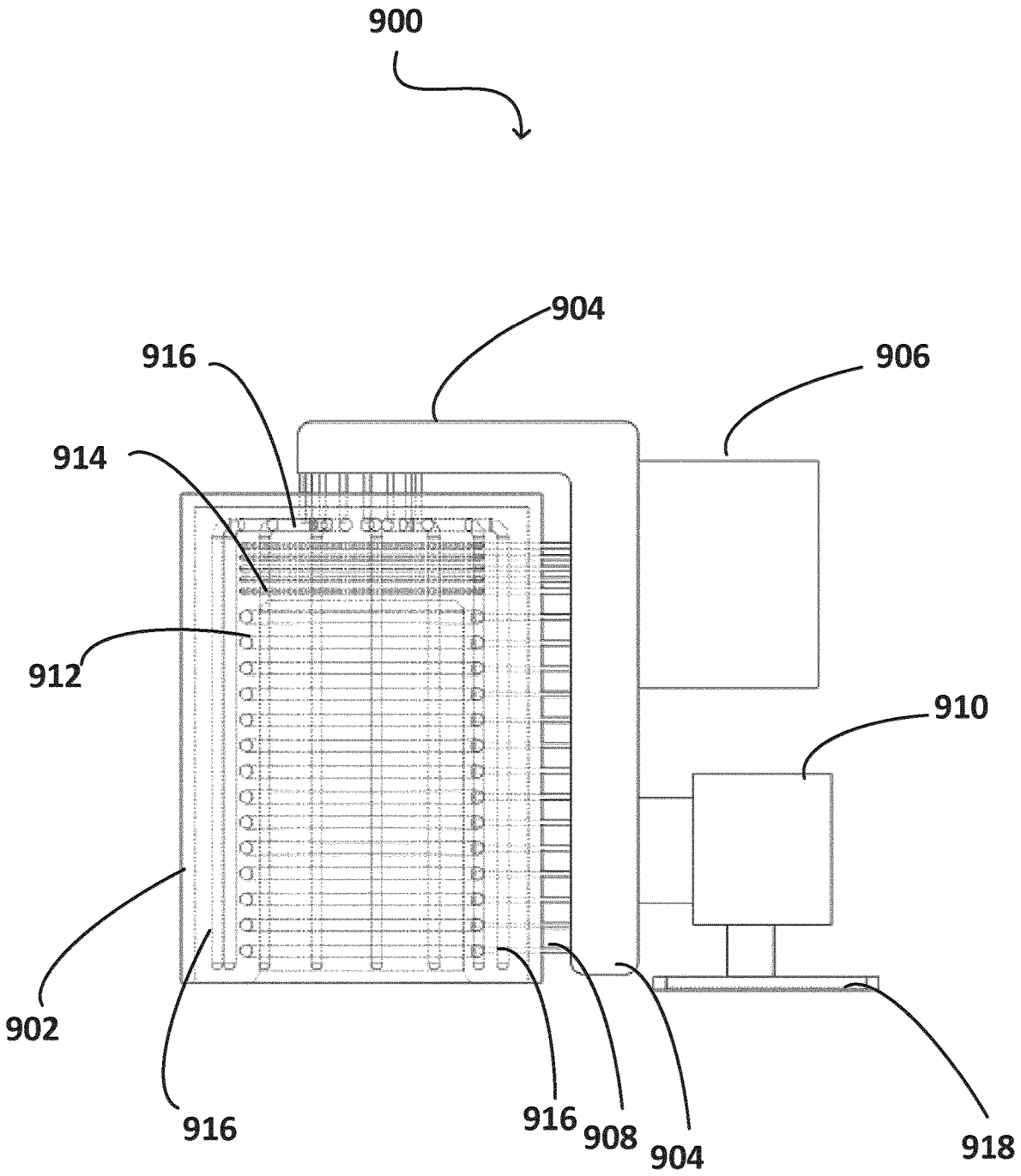

FIGS. 8A-C illustrate the apparatus illustrated in FIGS. 7A-B further comprising an exterior shell (712).

FIGS. 9A-E illustrate a system according to the present disclosure. The system (900) comprises an apparatus (902) as presently disclosed, a valve controller (904) coupled to the apparatus (902), a pump (906) coupled to the valve controller (904), a pressure sensor (908) coupled to the apparatus (902), and a processor (910) in communication with the apparatus (902), the valve controller (904), the pump (906), the pressure sensor (908), and configured to control the amount of fluid transferred to the expandable conduits (912) and the expandable bladder (914) of the apparatus (902) via a tube system (916). The system further comprises an interface (918) for use operation.

Figure 10A:
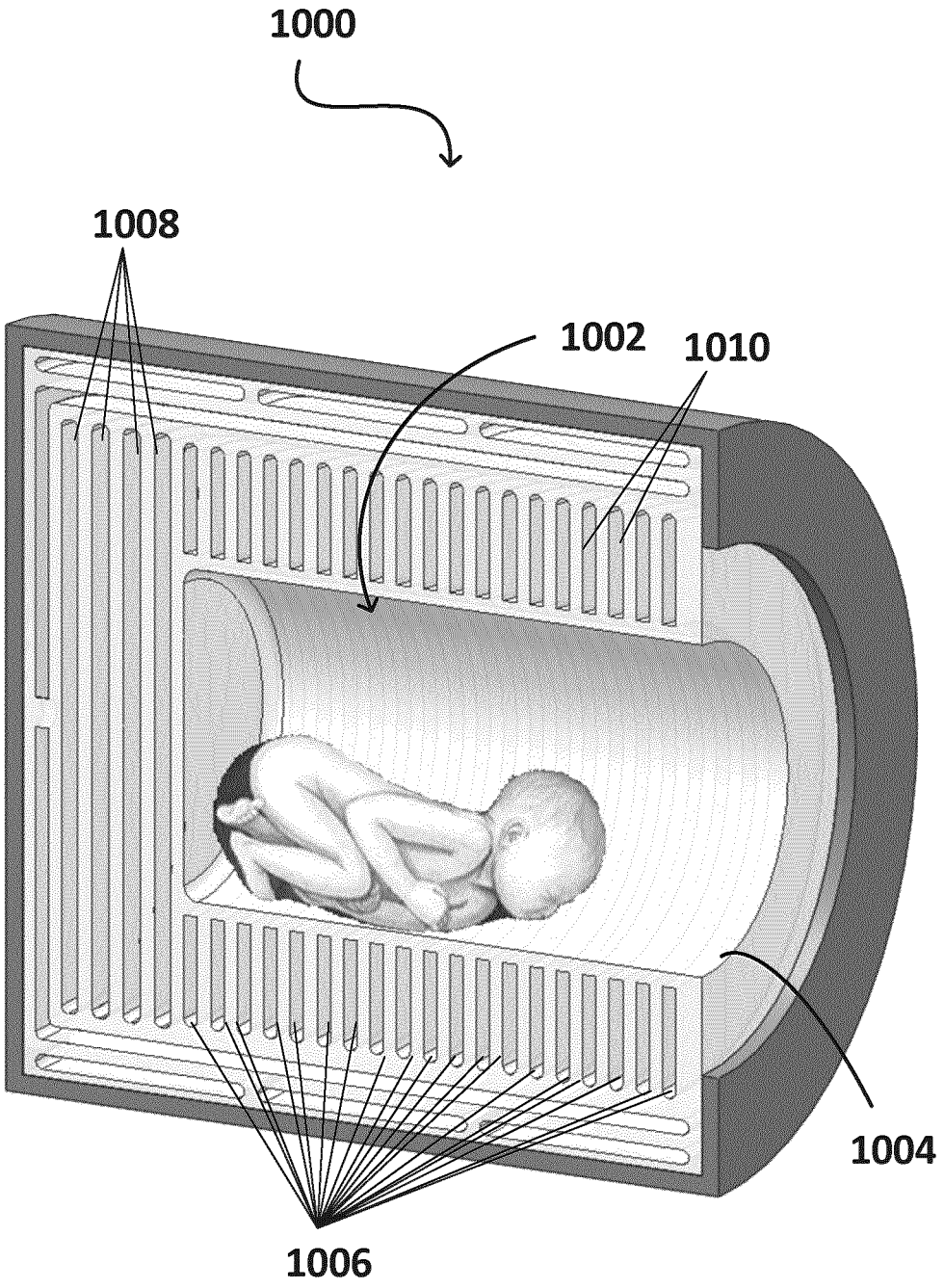
FIGS. 10A-B are illustrations of an example of an apparatus according to the present disclosure with an infant child therein in perspective cross-sectional views in an unexpanded state (FIG. 10A) and in an expanded state (FIG. 10B).
Figure 10B:
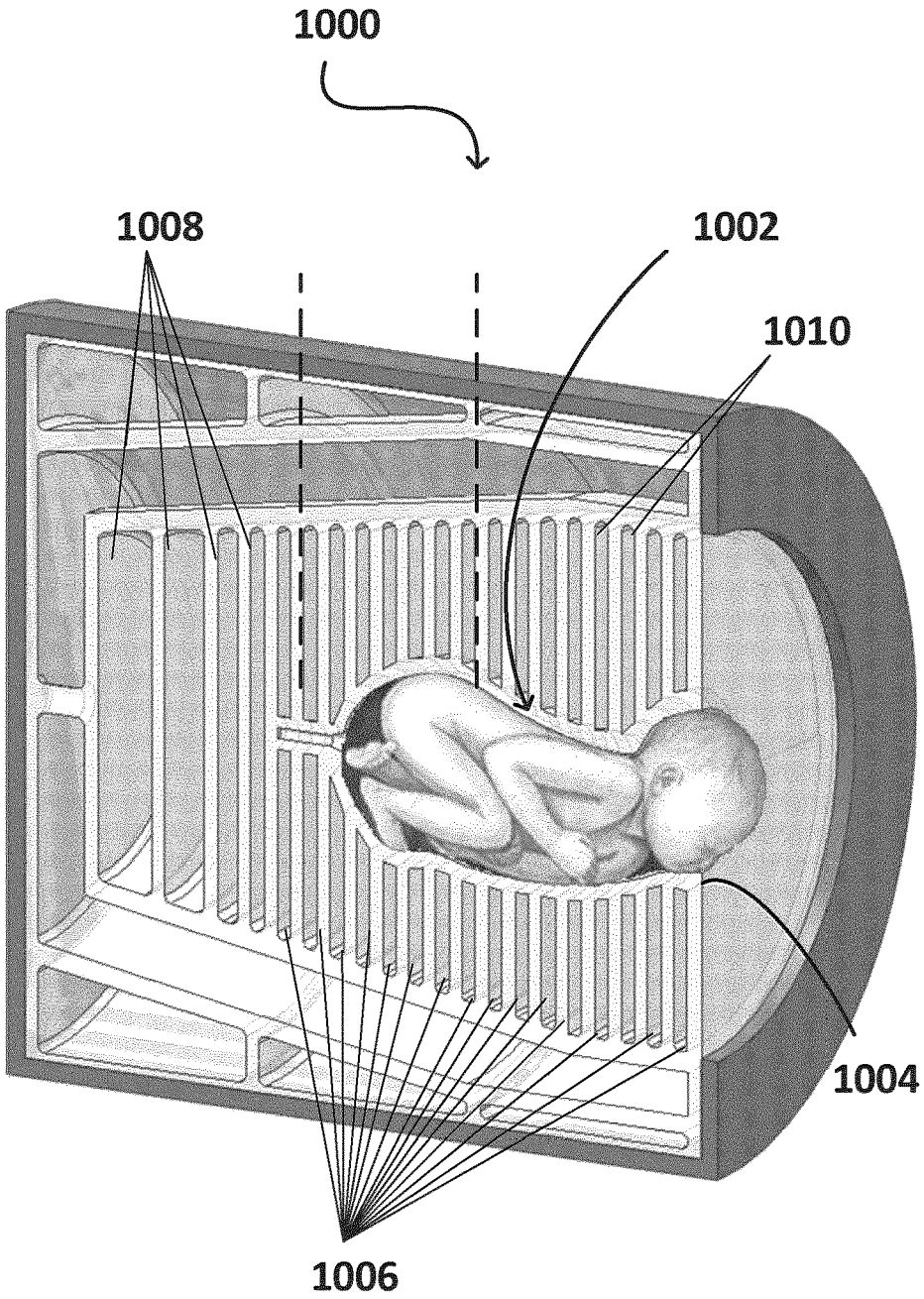

FIGS. 10A-B illustrate an apparatus according to the present disclosure with an infant child therein, in perspective cross-sectional views in an unexpanded state (FIG. 10A) and in an expanded state (FIG. 10B). The apparatus (1000) defines a cavity (1002) for holding the newborn baby therein and has an open end (1004) for inserting the newborn baby into the cavity (1002). The apparatus comprises expandable conduits (1006) that each surround the cavity (1002). Each conduit is independently expandable on transfer of fluid from a fluid source (now shown) into the conduit (1006) to apply pressure along at least a portion of the length of the newborn baby held in the cavity (1002). The expandable conduits (1006) are shown in unexpanded states in FIG. 10A and in expandable states in FIG. 10B. The apparatus (1000) also comprises expandable bladders (1008) opposite the open end (1004) shown in unexpanded states in FIG. 10A and in expanded states in FIG. 10B, the expandable bladders (1008) connected to a fluid source (now shown) and expandable on transfer of fluid from the fluid source into the bladders (1008) to apply pressure to the distal end of the newborn baby held in the cavity (1002). The dashed lines in FIG. 10B indicate a wave of pressure therebetween. Two of the expandable conduits (1010) apply pressure to the newborn baby independent of the generated wave of pressure and are positioned at a location along the newborn baby's length that is on the side of the generated wave that is closer to the newborn baby's head (shown in an unexpanded state in FIG. 10A and in an expanded state in FIG. 10B).

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding. For example, specific details are not provided as to whether the embodiments described herein are implemented as a software routine, hardware circuit, firmware, or a combination thereof.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

What is claimed is:

1. An apparatus for applying pressure to a newborn baby, the apparatus defining a cavity for holding the newborn baby therein, and having an open end for inserting the baby into the cavity, the apparatus comprising:

a plurality of expandable conduits that each substantially surround the cavity, wherein each conduit is independently expandable: (1) on transfer of fluid from a fluid source into the conduit; (2) on application of an electric potential from an electric potential source to the conduit; or (3) a combination thereof, to apply pressure along at least a portion of the length of the newborn baby held in the cavity; and an expandable bladder that covers the entire end of the cavity opposite the open end, the expandable bladder being connected to: (1) a fluid source and expandable on transfer of fluid from the fluid source into the bladder; (2) an electric potential source and expandable on application of electric potential to the bladder; or (3) a combination thereof, to apply pressure to the distal end of the newborn baby held in the cavity.

2. The apparatus of claim 1, wherein each conduit is independently expandable on transfer of fluid from a fluid source into the conduit.

3. The apparatus of claim 2, wherein the fluid is liquid or gas.

4. The apparatus of claim 2, wherein the side of each conduit proximal the cavity is expandable and the opposite side of each conduit is non-expandable.

5. The apparatus of claim 1, wherein each conduit is made of an elastomer.

6. The apparatus of claim 5, wherein the elastomer on the side of each expandable conduit proximal to the cavity has a lower resilience than the elastomer on the opposite side of each expandable conduit.

7. The apparatus of claim 1, wherein each conduit is independently expandable on application of an electric potential from an electric potential source to the conduit.

8. The apparatus of claim 7, wherein the conduit is made of a nanostructure comprising metal and an electrolyte.

9. The apparatus of claim 1, wherein the apparatus further comprises an exterior shell made of a metal material, a composite material, or a plastic material, the exterior shell coupled to an opposite, outer side of each expandable conduit.

10. The apparatus of claim 1, wherein the apparatus further comprises an interior shell made of a medical grade polymer, the interior shell coupled to the side of each expandable conduit proximal to the cavity.

11. The apparatus of claim 1, wherein the expandable bladder opposite the open end that is connected to a fluid source and expandable on transfer of fluid from the fluid source into the bladder.

12. A method for applying pressure to a newborn baby in a pressure applying apparatus, the apparatus defining a cavity for holding the newborn baby therein, and having an open end, wherein the pressure applying apparatus comprises:

a plurality of independently operable pressure applying portions and a distal pressure applying portion that covers the entire end opposite the open end, the method comprising independently applying pressure using each of the pressure applying portions to generate a wave of pressure along at least a portion of the length of the newborn baby; and applying pressure using the distal pressure portion to generate a pressure at the distal end of the newborn baby to push the newborn baby through the apparatus.

13. The method of claim 12, wherein each of the plurality of pressure applying portions applies a pressure around the newborn baby in a plane about perpendicular to the length of the newborn baby.

14. The method of claim 12, further comprising the step of determining the volume of the newborn baby.

15. A system for applying pressure to a newborn baby, the system comprising:

the apparatus of claim 1;

a pressure sensor, coupled to the apparatus; and any one of the group selected from:

(1) a valve controller coupled to the apparatus, a pump coupled to the valve controller, and a processor in communication with: the apparatus; the valve controller; the pump; and the pressure sensor, and configured to control the amount of fluid transferred to the expandable conduits;

(2) an electric potential controller coupled to the apparatus, and a processor in communication with: the apparatus; the pressure sensor, and the electric potential controller, and configured to control the amount of electric potential applied to the expandable conduits; and (3) a combination thereof.

16. The system of claim 15, wherein the system comprises: (1) a valve controller coupled to the apparatus, a pump coupled to the valve controller, and a processor in communication with: the apparatus; the valve controller; the pump; and the pressure sensor, and configured to control the amount of fluid transferred to the expandable conduits.

17. The apparatus of claim 1, wherein the expandable bladder is expandable independently from the plurality of expandable conduits.

18. The apparatus of claim 1, wherein the expandable bladder applies pressure to the distal end of the newborn baby in a direction towards the open end.

* * * * *